US007668711B2

(12) United States Patent
Chong et al.

(10) Patent No.: US 7,668,711 B2
(45) Date of Patent: Feb. 23, 2010

(54) CODING EQUIPMENT

(75) Inventors: Kok Seng Chong, Singapore (SG); Sua Hong Neo, Singapore (SG); Naoya Tanaka, Osaka (JP); Takeshi Norimatsu, Hyogo (JP)

(73) Assignee: Panasonic Corporation, Osaka (JP)

( * ) Notice: Subject to any disclaimer, the term of this patent is extended or adjusted under 35 U.S.C. 154(b) by 620 days.

(21) Appl. No.: 10/575,452

(22) PCT Filed: Apr. 20, 2005

(86) PCT No.: PCT/JP2005/007498

§ 371 (c)(1),
(2), (4) Date: Apr. 12, 2006

(87) PCT Pub. No.: WO2005/104094

PCT Pub. Date: Nov. 3, 2005

(65) Prior Publication Data

US 2007/0156397 A1 Jul. 5, 2007

(30) Foreign Application Priority Data

Apr. 23, 2004 (JP) ..... 2004-128961

(51) Int. Cl.
*G10L 19/00* (2006.01)

(52) U.S. Cl. ..... 704/219; 704/221; 704/500

(58) Field of Classification Search ..... 704/219, 704/221, 500

See application file for complete search history.

(56) References Cited

U.S. PATENT DOCUMENTS

| | | | | |
|---|---|---|---|---|
| 7,187,907 | B2 * | 3/2007 | Widrow | 455/73 |
| 2002/0087304 | A1 | 7/2002 | Kjorling et al. | |
| 2004/0128126 | A1 * | 7/2004 | Nam et al. | 704/225 |
| 2004/0247037 | A1 | 12/2004 | Honma et al. | |
| 2005/0091040 | A1 * | 4/2005 | Nam et al. | 704/201 |
| 2005/0096917 | A1 | 5/2005 | Kjorling et al. | |

FOREIGN PATENT DOCUMENTS

| | | |
|---|---|---|
| EP | 1 531 551 | 5/2005 |
| JP | 7-295594 | 11/1995 |
| JP | 7-336231 | 12/1995 |
| JP | 2004-80635 | 3/2004 |
| JP | 3646939 | 2/2005 |
| JP | 2005-510772 | 4/2005 |
| JP | 2005-520219 | 7/2005 |
| WO | 98/57436 | 12/1998 |
| WO | 00/45379 | 8/2000 |
| WO | 01/26095 | 4/2001 |
| WO | 03/046891 | 6/2003 |
| WO | 2004/019497 | 4/2004 |
| WO | 2004/027368 | 4/2004 |

* cited by examiner

*Primary Examiner*—Daniel D Abebe
(74) *Attorney, Agent, or Firm*—Wenderoth, Lind & Ponack L.L.P.

(57) ABSTRACT

According to the present invention, it is possible to calculate appropriate chirp factor and noise component amount with a little processing amount.

Input subband signal is segmented into a plurality of ranges by a range segmentation unit 101. The range segmentation is performed for energy value calculation, chirp factor calculation, noise component calculation, and tone component calculation, respectively, and determined range segmentation information ei, bi, qi, and hi are outputted. Respective processing for the energy calculation, the chirp factor calculation, the tone component calculation, and the noise component calculation are performed sequentially for the respective corresponding ranges. By using linear prediction processing, it is possible to obtain an parameter having higher accuracy with a little operation amount.

15 Claims, 15 Drawing Sheets

Frequency Sample
701
e5
e11
e14
e20
e23
e4
e10
e19
e3
e9
e18
e22
e2
e8
e17
e1
e7
e16
e21
e0
e6
e12
e15
e13
T 702
q2
q5
q1
q4
q0
q3
T(i)

703
704
h8
h17
h7
h16
h6
h15
h5
h14
h4
h13
h3
h12
h2
h11
h1
h10
h0
h9
T(i)
Time Sample

FIG. 7

| | Energy Value of Replicated High-Frequency Subband Signal | Energy Value of Artificially Added Noise Component | Energy Value of Artificially Added Tone Component |
|---|---|---|---|
| If H(t,k)=0 (Without Sinewave Addition) | $E(t,k)\left(\frac{1}{1+Q(t,k)}\right)$ | $E(t,k)\left(\frac{Q(t,k)}{1+Q(t,k)}\right)$ | 0 |
| If H(t,k)=1 (With Sinewave Addition) | $E(t,k)\left(\frac{Q(t,k)}{1+Q(t,k)}\right)$ | 0 | $E(t,k)\left(\frac{1}{1+Q(t,k)}\right)$ |

FIG. 13

| Case | (1101)<br>Tone is in k | (1102)<br>Tone is between k,k+1 | (1103)<br>Tone is between k,k−1 |
|---|---|---|---|
| Energy Criteria | E(k)>Ethres*E(k−1)<br>AND<br>E(k)>Ethres*E(k+1) | E(k)>Ethres*E(k−1)<br>AND<br>E(k+1)>Ethres*E(k+2) | E(k)>Ethres*E(k+1)<br>AND<br>E(k−1)>Ethres*E(k−2) |
| Tonality Criteria | q_hi(k)>Qthres | q_hi(k)>Qthres<br>OR<br>q_hi(k+1)>Qthres | q_hi(k)>Qthres<br>OR<br>q_hi(k−1)>Qthres |

CODING EQUIPMENT

TECHNICAL FIELD

The present invention relates to a coding equipment which efficiently compresses and encodes a spectrum of an audio signal, and applies the compressed and encoded signal to generate an audio signal with a high audio quality.

BACKGROUND ART

The objective of audio coding is to compress and transmit a digitized audio signal as effectively as possible, and to apply decoding processing to the compressed signal at a decoder, so that it is possible to reproduce as a high quality audio signal as possible. FIG. 1 is diagrams showing structures of a conventional encoder 200 and a conventional decoder 210 for applying an audio signal with typical compression encoding processing and typical decoding processing. As one example of the above, FIG. 1 shows the most typical compressing method applied to an audio signal. The conventional encoder 200 includes a frame segmentation unit 201, a spectrum transformation unit 202 and a spectrum encoding unit 203. The frame segmentation unit 201 divides an input audio signal in time domain into frames each of which has a predetermined number of consecutive samples. The spectrum transformation unit 202 transforms the input audio signal samples in each frame into a spectrum signal in frequency domain. The spectrum encoding unit 203 quantizes the spectrum signal up to a certain frequency generally known as the bandwidth and outputs the results as encoded data (bitstream). The outputted bitstream is transmitted to the decoder 210 via, for example, a transmission channel or a recording medium. On the other hand, the decoder 210, which receives the encoded data as an input bitstream from the encoder 200, includes a spectrum decoding unit 204, a spectrum inverse transformation unit 205, and a frame assembling unit 206. The spectrum decoding unit 204 obtains a spectrum signal by de-quantizing the encoded data of the input bitstream. The obtained spectrum signal is inverse-transformed by the spectrum inverse transformation unit 205 back into a time signal. Thereby the audio signal is generated on a frame to frame basis. The audio signals in respective frames are then assembled by the frame assembling unit 206 to form an output audio signal.

FIG. 2 is a graph showing one example of an audio signal whose high-frequency signal is lost due to the conventional low-bitrate coding. Here, as the bitrate that is an encoded amount per a unit time available to indicate the audio signal decreases, more sacrifice has to be made to a bandwidth 301 of an audio signal to be encoded. Here, a high-frequency component (high-frequency signal) is not as perceptually important as a low-frequency component (low-frequency signal), so that a bandwidth to be encoded is reduced firstly from the high-frequency component. As a result, for the low-bitrate coding, as shown in FIG. 2, a high-frequency tone signal 303 and a high-frequency component 304 which exists as harmonics of the low-frequency component are lost. In general, a range 302 to be decoded at the conventional decoder is equal to the bandwidth 301 of the signal to be encoded, so that perceptual audio quality is reduced. Bandwidth extension is a technology for recovering the high-frequency component which has been lost due to the above reason, and one typical example of such a technique is the Spectral Band Replication (SBR) method which is established as a standard method, ISO/IEC14496-3 MPEG-4Audio. The technology is described also in a patent reference 1.

As one example of the conventional technology of the present invention, the SBR method is used. FIG. 3 is a block diagram showing a structure of a decoder 400 which decodes an encoded bitstream by the SBR method. The decoder 400 is a decoder having a function of extending a bandwidth using the SBR method. The decoder 400 includes a bitstream de-multiplex unit 401, a core audio decoding unit 402, an analysis subband filter unit 403, a bandwidth extension unit 404, and a synthetic subband filter unit 405. Firstly, at the bitstream de-multiplex unit 401, an input bitstream is separated to become a core audio part of bitstream and a bandwidth extended part of bitstream. The core audio part of bitstream has been generated by encoding an low-frequency audio spectrum signal, and the bandwidth extended part of bitstream has been generated by encoding bandwidth extension information for generating a high-frequency signal by using the low-frequency signal coded in the core audio part. The core audio decoding unit 402 decodes the core audio part of bitstream to generate a time signal of the low-frequency component. The core audio decoding unit 402 may be any existing decoding unit, but in a case of the MPEG-4Audio standard, an AAC method that is also the MPEG-4 standard is used, for example. The decoded low-frequency component signal is then band-split into M-channel subband signals at the analysis subband filter unit 403. Subsequent bandwidth extension processing is performed for these subband signals (low-frequency subband signals). The bandwidth extension unit 404 processes the low-frequency subband signals using the bandwidth extension information in the bandwidth extended part, and generates new high-frequency subband signals which indicate high-frequency component signals. The generated high-frequency subband signals are inputted as N-channel subband signals together with the low-frequency subband signals into the synthetic subband filter unit 405, and are applied with assembling processing to form an output audio signal. In FIG. 3, the output audio signals from synthetic filters M to N−1 are shown as bandwidth extended signals. It is assumed that the subband signals used herein are indicated by segmenting an audio signal as a time signal into subbands in the frequency direction and by two-dimensionally arranging time samples included in each subband.

FIG. 4 is a diagram showing processing by which the bandwidth extension unit 404 shown in FIG. 3 processes the low-frequency subband signals to generate the high-frequency subband signals. The replicated high-frequency subband signal 501 is generated by replicating the low-frequency subband signal 502 at the high frequency. During the replication processing, the inverse filtering 503 restrains tonal characteristics of the low-frequency subband signal. A degree of the tonal restraint is controlled using a value called a chirp factor 504 (equivalent to an "adjustment coefficient" in the Claims of the present invention). A plurality of consecutive subbands are grouped and an identical chirp factor is applied to the groups, and the groups are hereinafter referred to as chirp factor bands. Here, a typical D-dimensional inverse filter is calculated according to the following equation:

$$X_{high}(t,k) = X_{low}(t, p(k)) + \sum_{i=0}^{i=D-1} B_j^i \alpha_i X_{low}(t-i, p(k)), \quad \text{[Equation 1]}$$

where $X_{high}(t,k)$ is a generated high-frequency subband signal, $X_{low}(t,k)$ is a low-frequency subband signal, t is a time sample position, k is a subband number, $a_i$ is a linear predictor coefficient calculated by linear prediction using $X_{low}(t,k)$, p(k) is a mapping function for determining a low-frequency subband signal corresponding to the k-th high-frequency subband signal, and $B_j$ is a chirp factor corresponding to a chirp factor band bj set for the high-frequency subband signal $X_{high}$ (t,k).

Technical details of the inverse filtering and a method of determining the mapping function p(k) are not included in the disclosure of the present invention, so that explanation for the technical details and the method are not described herein. Note that the chirp factor $B_j$ is a value that is equal to or more than zero and equal to or less than 1, and effects of the tonal restraint become maximum when $B_j$=1 and minimum when $B_j$=0. Information of grouping the chirp factor bands and chirp factors for respective chirp factor bands are encoded, included in a bitstream, and then transmitted.

Subsequently, for the generated high-frequency subband signal, an envelope shape (roughly indicated signal energy distribution) is adjusted so that the generated high-frequency subband signal can have frequency characteristics similar to frequency characteristics of a high-frequency subband signal of original sound. One example of such a method of adjusting the envelope shape is a patent reference 2. A high-frequency subband signal indicated as two-dimensional time/frequency representation is divided first in the time direction into "time segments" and then in the frequency direction into "frequency bands". FIG. 5 shows this processing for dividing a high-frequency subband signal. FIG. 5 is a graph showing one example of the segmentation method of dividing a high-frequency subband signal into time segments and frequency bands. Arrows 601 depict segmentation of the high-frequency subband signal in the time direction, and arrows 602 depict in the frequency direction. Each area of the high-frequency subband called an "energy band" which is divided in the time and frequency directions is scaled in order to correspond an energy value given for the area. The information of segmentation in the time/frequency directions used for the envelope shape adjustment, and the energy value for each divided area are encoded at the encoder 200, included in a bitstream, and then transmitted.

Furthermore, in addition to the envelope shape adjustment of the energy, a tone-to-noise ratio of the generated high-frequency subband signal is also an important factor for increasing expression of the generated signal and thereby realizing audio quality with higher fidelity to the input signal. When a noise component is lacking partially in the generated high-frequency subband signal, an artificial noise component is added in order to compensate the noise component lack. In the same manner, when a tonal component is lacking partially, an artificial tone component (sinewave) is added. The noise component is added at an area called a "noise band", and the sine signal is added at an area called a "tone band". FIG. 6(*a*) to (*c*) are graphs showing one example of segmentation of the high-frequency subband signal by grouping the divided high-frequency area as shown in FIG. 5 as an energy-band group, a noise-band group, and a tone-band group, respectively. The relationship among the energy bands, the noise bands, and the tone bands is shown in FIG. 6(*a*) to (*c*). The time-frequency space segmentation in FIG. 6(*a*) shows areas each of which is given with the same energy value for the envelope shape adjustment of the high-frequency subband signal. In FIG. 6(*a*), in a time-frequency space segmentation method 701, areas indicated as ei (i=0, 1, . . . , 23) are energy bands. In FIG. 6(*b*), in a time-frequency space segmentation method 702, areas indicated as qi (i=0, 1, . . . , 23) are noise bands. Note that the noise band segmentation and the chirp factor segmentation are identical. Furthermore, in FIG. 6(*c*), for a time-frequency space segmentation method 703, areas indicated as hi (h=0, 1, . . . , 23) are tone bands. The artificial sinewave is added to a subband that exists in a center of the high-frequency subband signal included in a tone band h16, as shown in the subband 704 added with a sinewave tone signal in FIG. 6(*c*). The information of the noise band segmentation and the tone band segmentation, an amount of noise added to each noise band, and information regarding necessity of tone signal addition at each tone band are encoded at the encoder, included in a bitstream, and then transmitted.

The following describes a method of calculating signal energy in each energy band, noise band (chirp factor band), and tone band. In the following description, B(t,k), E(t,k), Q(t,k), and H(t,k) refer to a chirp factor, an energy value, a ratio of noise component in a signal, a flag indicating necessity of tone signal addition, respectively, regarding a signal indicated by a time sample t and a frequency band k in the time/frequency representation of the high-frequency subband signal. As a rule of the notation, a signal point (sample) indicated by all (t,k) included in a certain energy band ei is E(t,k)=Ei, for example. For the chirp factor band bi, the noise band qi, and the tone band hi, the same mapping is performed for B(t,k), Q(t,k), and H(t,k), respectively. FIG. 7 is a table showing, regarding an identical energy band, an energy ratio of a high-frequency subband signal generated by replicating a low-frequency subband signal to an artificially added noise or tone component. Each energy value of the high-frequency subband signal generated by replicating the low-frequency subband signal, the artificially added noise component, and the artificially added tone component are calculated as shown in FIG. 7.

An important point of the energy value calculation is that a sum of three energy values of the high-frequency subband signal generated by replicating the low-frequency subband signal, the artificially added noise component, and the artificially added tone component is always equal to E(t,k). Therefore, a ratio Q(t,k) of the noise component is used to divide all signal energy E(t,k) into the replicated high-frequency subband signal and the artificially added noise or tone component.

A parameter necessary for the bandwidth extension processing as described above needs to be appropriately set at the encoder in order to generate a bitstream having high audio quality and proper syntax. Especially, in order to properly calculate the energy value of the high-frequency subband signal, the chirp factor, the existence of a tone signal, and the ratio of noise component, a technique is necessary to analyze an input signal indicated by the time/frequency representation. Without proper calculation of those information, for example, reproduced sound becomes noisy since the ratio of noise component becomes too high, and due to improper tone component addition or inverse filtering, the sound becomes unclear and, at worst, becomes distorted. Among those information, an example of a method of calculating the chirp factor is disclosed in a patent reference 3. According to the method, a tone-to-noise ratio of a high-frequency signal of an input signal is compared with a tone-to-noise ratio of a signal generated by replicating a low-frequency signal at high frequency, and the ratios are calculated using a simple mathematical formula, so that the chirp factor can be calculated. Moreover, an example of a method of calculating the ratio of noise component is described in a patent reference 4. According to the method, an input signal that is a time signal is divided into time frames, and then transformed into spectrum coefficients by using Fourier transformation. Indicators called a "peak follower" and a "dip follower" which represent a peak and a fall, respectively, of the spectrum coefficients are set for the calculated spectrum coefficients, and the ratio of noise component is determined from a spectrum energy value of a noise component derived from the two indicators.

Patent Reference 1: International Publication No. WO98/57436

Patent Reference 2: International Publication No. WO01/26095

Patent Reference 3: U.S. Publication No. US2002/0087304

Patent Reference 4: International Publication No. WO00/45379

DISCLOSURE OF INVENTION

Problems that Invention is to Solve

However, in the conventional methods, when the tone-to-noise ratio of the high-frequency signal of input signal and the tone-to-noise ratio of the signal generated by replicating a low-frequency signal at high frequency are substituted in a simple equation in order to calculate the chirp factor, if during the chirp factor calculation, the tone-to-noise ratio of the high-frequency signal of original sound is extremely high or if the tone-to-noise ratio of the signal generated by replicating a low-frequency signal is extremely low, there is a possibility that an appropriate chirp factor fails to be calculated. As a result, there is a problem that audio quality is reduced due to use of the inappropriate chirp factor. Moreover, in a case where the Fourier transformation is applied to the high-frequency signal of original sound in order to correctly analyze peaks and falls of the spectrum coefficients of the Fourier-transformed high-frequency signal, when the chirp factor or the ratio of noise component is calculated, energy value calculation is necessary for the Fourier-transformed spectrum coefficients, which results in an increase of a calculation amount.

In order to solve these problems, an object of the present invention is to provide a coding equipment which can calculate an appropriate chirp factor without using processing that requires a large amount of calculation loads such as the Fourier transformation.

Means to Solve the Problems

In order to solve above problems a coding equipment which generates a coded signal that includes information for generating a signal at a high-frequency range by replicating a signal at a low-frequency range, the ranges being segments in a time direction and in a frequency direction. The coding equipment includes: a tone-to-noise ratio calculation unit operable to calculate, using linear prediction processing, a tone-to-noise ratio of the signal at the segmented high-frequency range and a tone-to-noise ratio of the signal at the low-frequency range to be replicated at the high-frequency range, the tone having signal components that exist intensely at a specific frequency range and the noise having signal components that exist regardless of frequency range; an adjustment coefficient calculation unit operable to calculate an adjustment coefficient which is used to adjust tonal characteristics of the signal at the low-frequency range to be replicated at the high-frequency range, based on the tone-to-noise ratios calculated regarding the signals at the low frequency range and the high frequency range; and an encoding unit operable to generate the coded signal that includes the calculated adjustment coefficient.

Effects of the Invention

According to the present invention, by performing pluralistic estimation of tone-to-noise ratios of an input signal and a replicated signal, and of an appropriate chirp factor, it is possible to calculate a more appropriate chirp factor and use the calculated chirp factor. Thereby it is possible to improve quality of reproduced sound.

Furthermore, by processing for a subband signal, a chirp factor, a ratio of a noise component, and presence of a tone component are systematically determined, which makes it possible to obtain appropriate information with less processing amount.

BRIEF DESCRIPTION OF DRAWINGS

FIG. 7 is a table showing, regarding an identical energy band, an energy ratio of a high-frequency subband signal which is obtained by replicating a low-frequency subband signal to an artificially added noise or tone component.

FIG. 13 is a table used for determining whether or not a tone component exists in a current subband by comparing energy of adjacent signals.

| Numerical References | |
|---|---|
| 100 | encoder |
| 101 | range segmentation unit |
| 102 | range segmenting information |
| 103 | energy calculation unit |
| 104 | chirp factor calculation unit |

-continued

| Numerical References | |
|---|---|
| 105 | tone signal addition determination unit |
| 106 | noise component amount calculation unit |
| 107 | bitstream calculation unit |
| 200 | encoder |
| 201 | frame segmentation unit |
| 202 | spectrum transformation unit |
| 203 | spectrum encoding unit |
| 204 | spectrum decoding unit |
| 205 | spectrum inverse transformation unit |
| 206 | frame assembling unit |
| 210 | decoder |
| 301 | bandwidth of signal to be coded |
| 302 | range to be decoded by a decoder |
| 303 | high-frequency tone signal |
| 304 | harmonic structure |
| 400 | decoder |
| 401 | bitstream de-multiplex unit |
| 402 | core audio decoding unit |
| 403 | analysis subband filter |
| 404 | bandwidth extension unit |
| 405 | synthetic subband filter |
| 501 | replicated high-frequency subband signal |
| 502 | low-frequency subband signal |
| 503 | inverse filtering |
| 504 | chirp factor |
| 601 | segmentation in the time direction |
| 602 | segmentation in the frequency direction |
| 701 | energy band |
| 702 | noise band |
| 703 | tone band |
| 704 | subband to be added with a sinewave tone signal |
| 901 | core audio encoding unit |
| 902 | analysis subband filter |
| 903 | bandwidth extension information encoding unit |
| 904 | bitstream multiplex unit |
| 1001 | area where a chirp factors is "0" |
| 1101 | subband energy |
| 1102 | subband energy |
| 1103 | subband energy |

BEST MODE FOR CARRYING OUT THE INVENTION

Embodiment

The following describes an embodiment according to the present invention with reference to the drawings. In the present embodiment, a subband signal at low frequency is replicated at a high-frequency subband, and the replicated signal is added with a tone signal or a noise, so that it is possible to generate a subband signal at high frequency.

Figure 8:
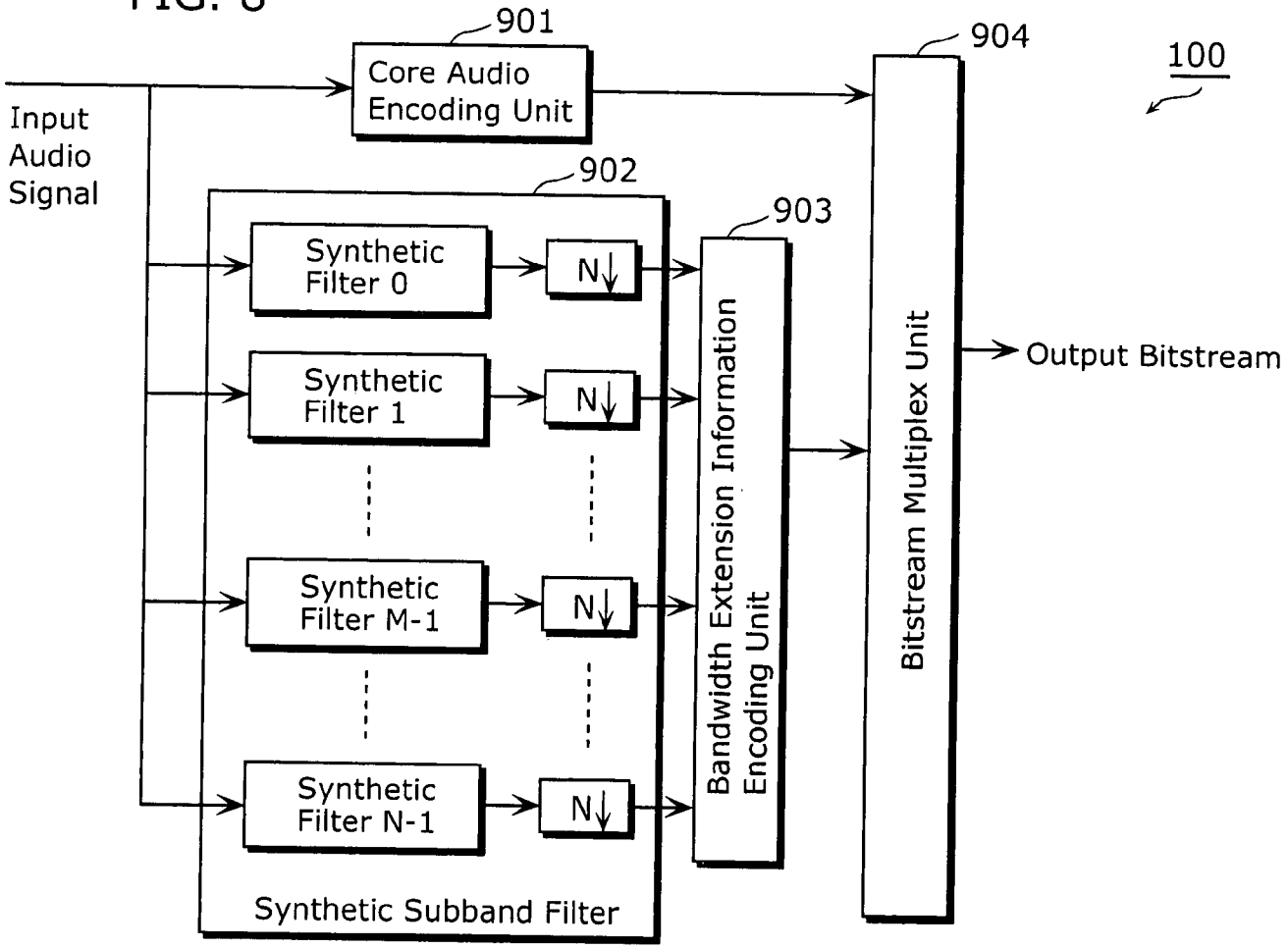
FIG. 8 is a block diagram showing a structure of an encoder according to the present embodiment.

FIG. 8 is a block diagram showing a structure of an encoder 100 according to the present embodiment. The encoder according to the present embodiment is an encoder which analyzes an input high-frequency subband signal using a simple method without using a calculation method, such as the Fourier transformation, that requires a large amount of loads, and encodes bandwidth extension information for generating a high-frequency subband signal from a low-frequency subband signal. The encoder includes a core audio encoding unit 901, an analysis subband filter 902, a bandwidth extension information encoding unit 903, and a bitstream multiplex unit 904. Furthermore, the analysis subband filter 902 includes N pairs of analysis filters and 1/N down-sampling units, and performs bandwidth segmentation for dividing an input audio signal into N-channel subband signals. Here, the analysis filters 0 to (N−1) are band-pass filters to output the same number of samples as the input samples, so that the 1/N down-sampling unit performs a N:1 down-sampling for each signal of the N-channel bands in order to remove redundancy. The bandwidth extension information encoding unit 903 extracts information necessary for bandwidth extension processing from a subband signal and encodes the extracted information. A structure and an operation of the bandwidth extension information encoding unit 903 are described in more detail further below. On the other hand, the core audio encoding unit 901 retrieves only a signal indicating a low-frequency component of the input signal, and encodes the obtained signal. Since the method of encoding the low-frequency component is not included within a scope of the present invention, the encoding method is not described herein, but the encoding method may be any existing method, such as MPEG AAC method. A result of encoding the low-frequency component and a result of encoding the bandwidth extension information are multiplexed at the bitstream multiplex unit 904 to generate an output bitstream.

Figure 1:
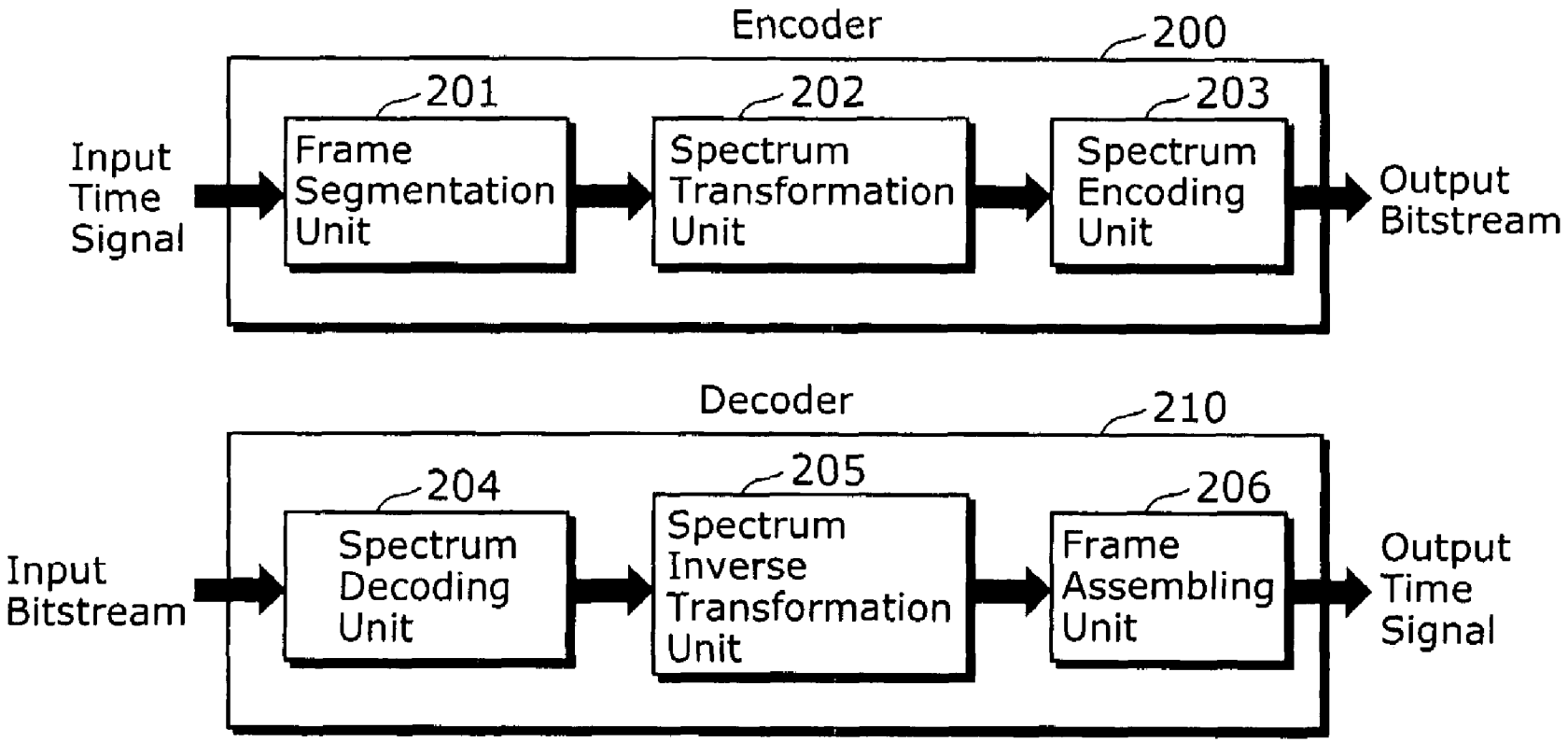
FIG. 1 is diagrams showing structures of the conventional encoder and decoder which apply an audio signal with compression coding processing and decoding processing.
Figure 2:
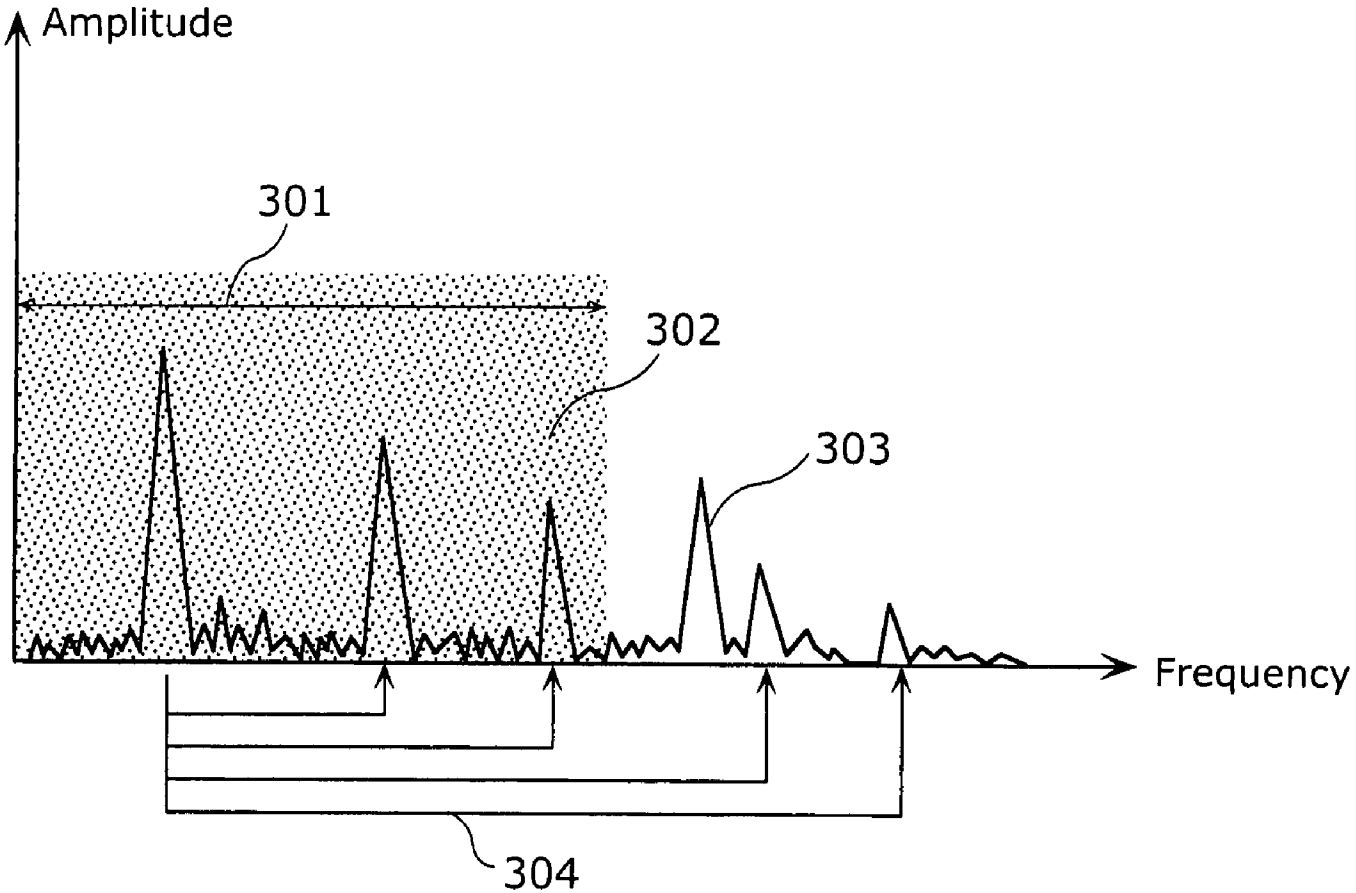
FIG. 2 is a graph showing one example of audio signals in which high-frequency signals are lost due to the conventional low-bitrate coding.
Figure 3:
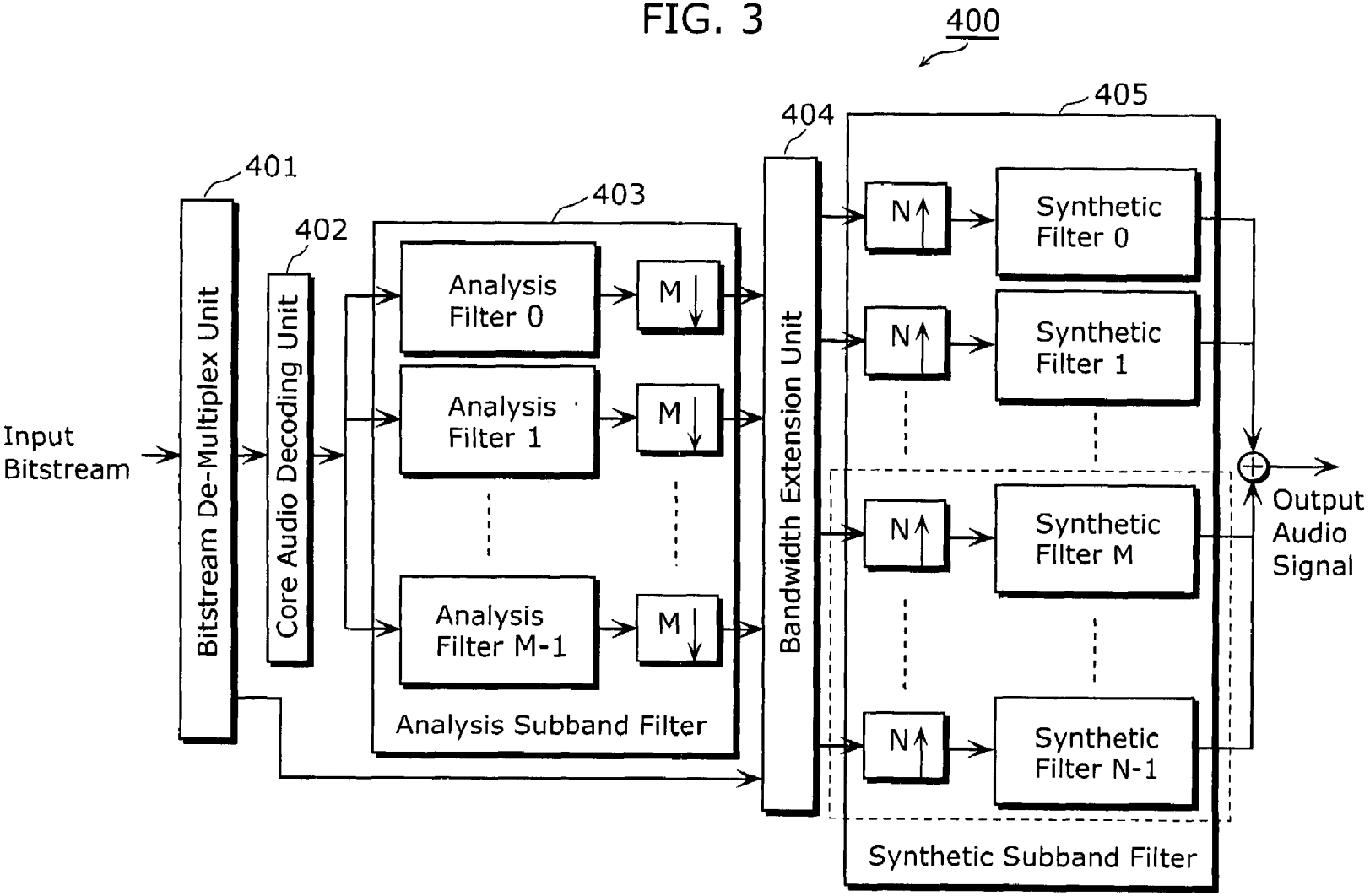
FIG. 3 is a block diagram showing a structure of the conventional decoder which decodes an encoded bitstream by the SBR method.
Figure 4:
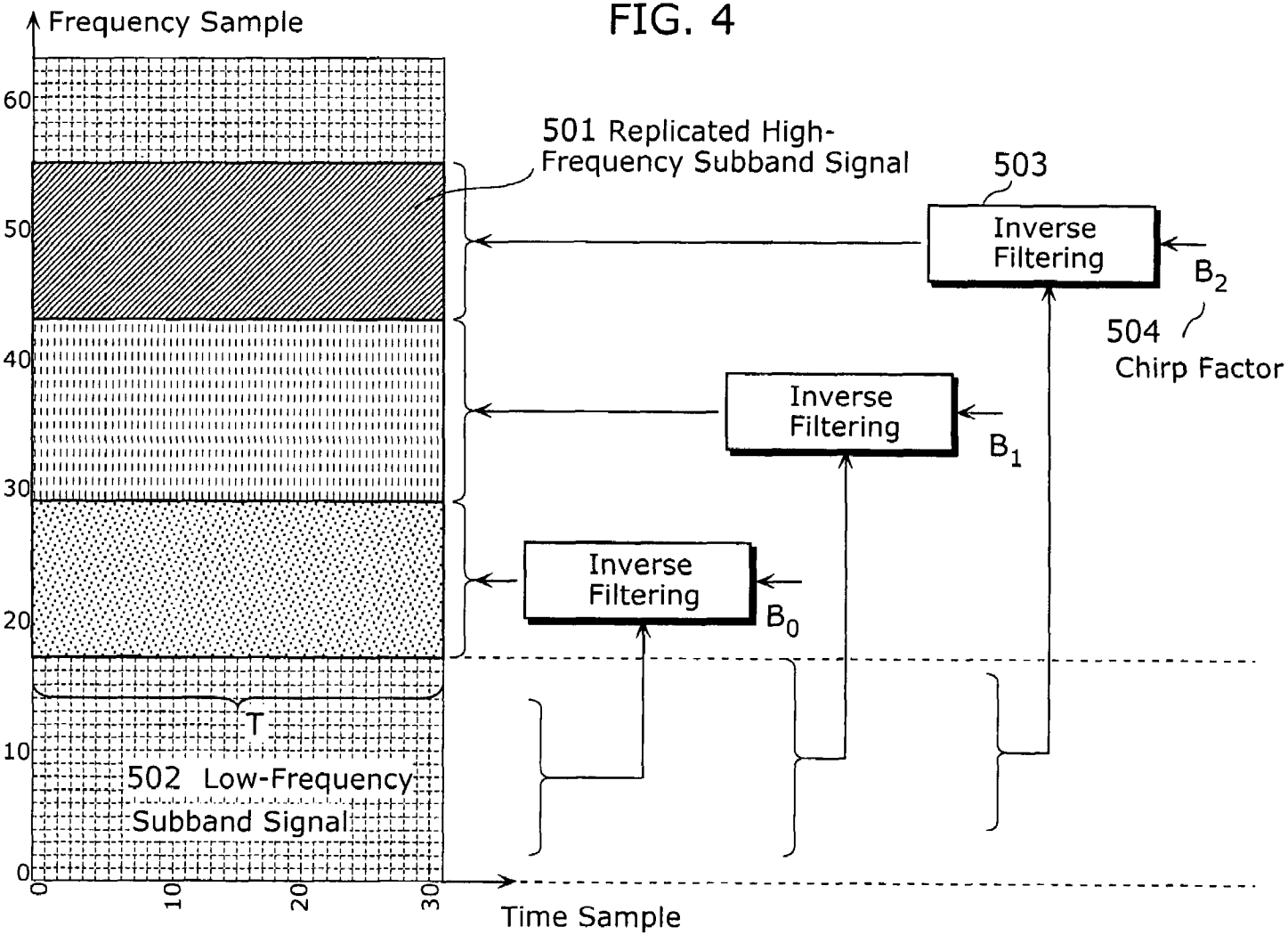
FIG. 4 is a graph showing processing by which a bandwidth extension unit shown in FIG. 3 processes a low-frequency subband signal to generate a high-frequency subband signal.
Figure 5:
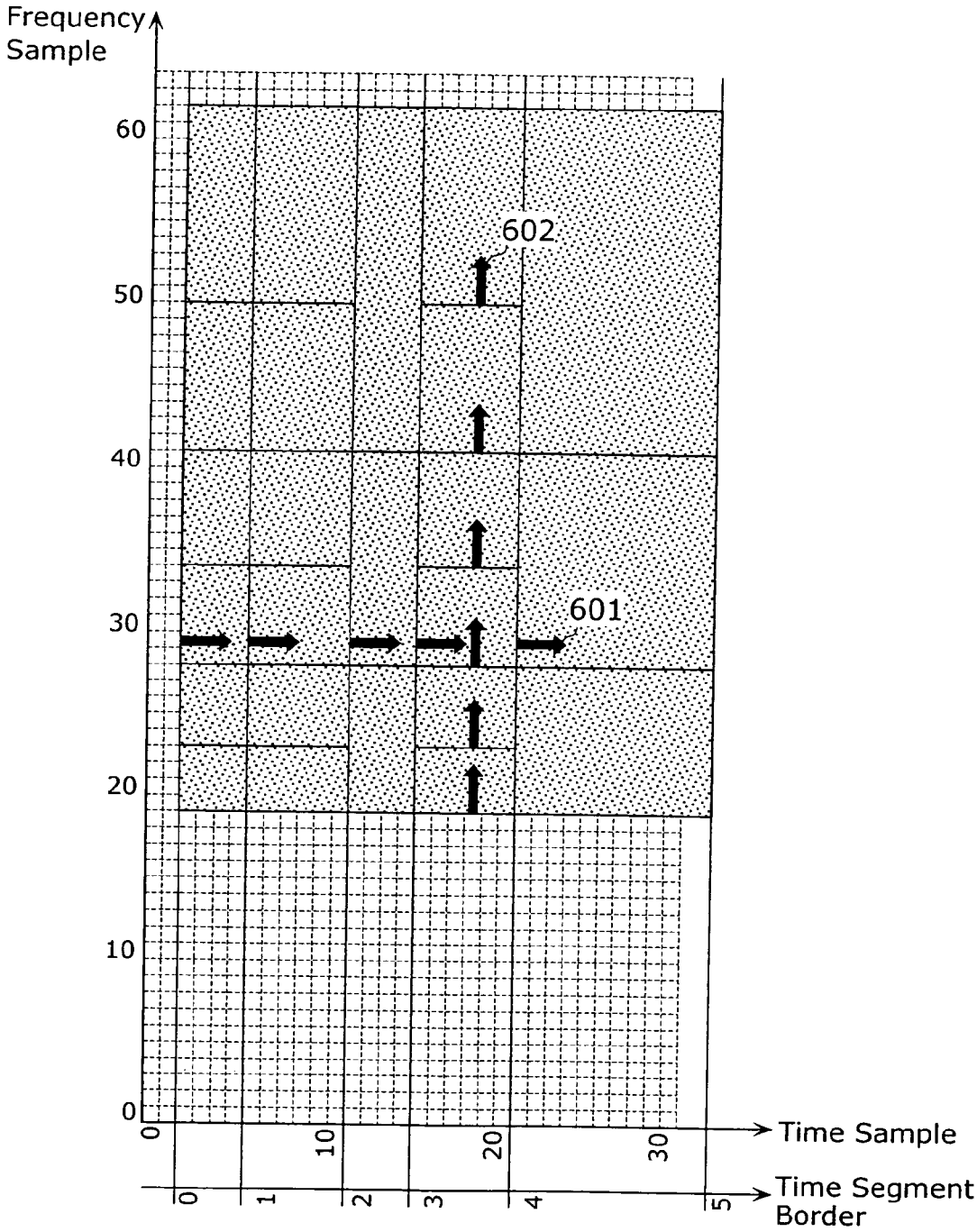
FIG. 5 is a graph showing one example of segmentation method of dividing a high-frequency subband signal into time segments and frequency bands.
Figure 9:
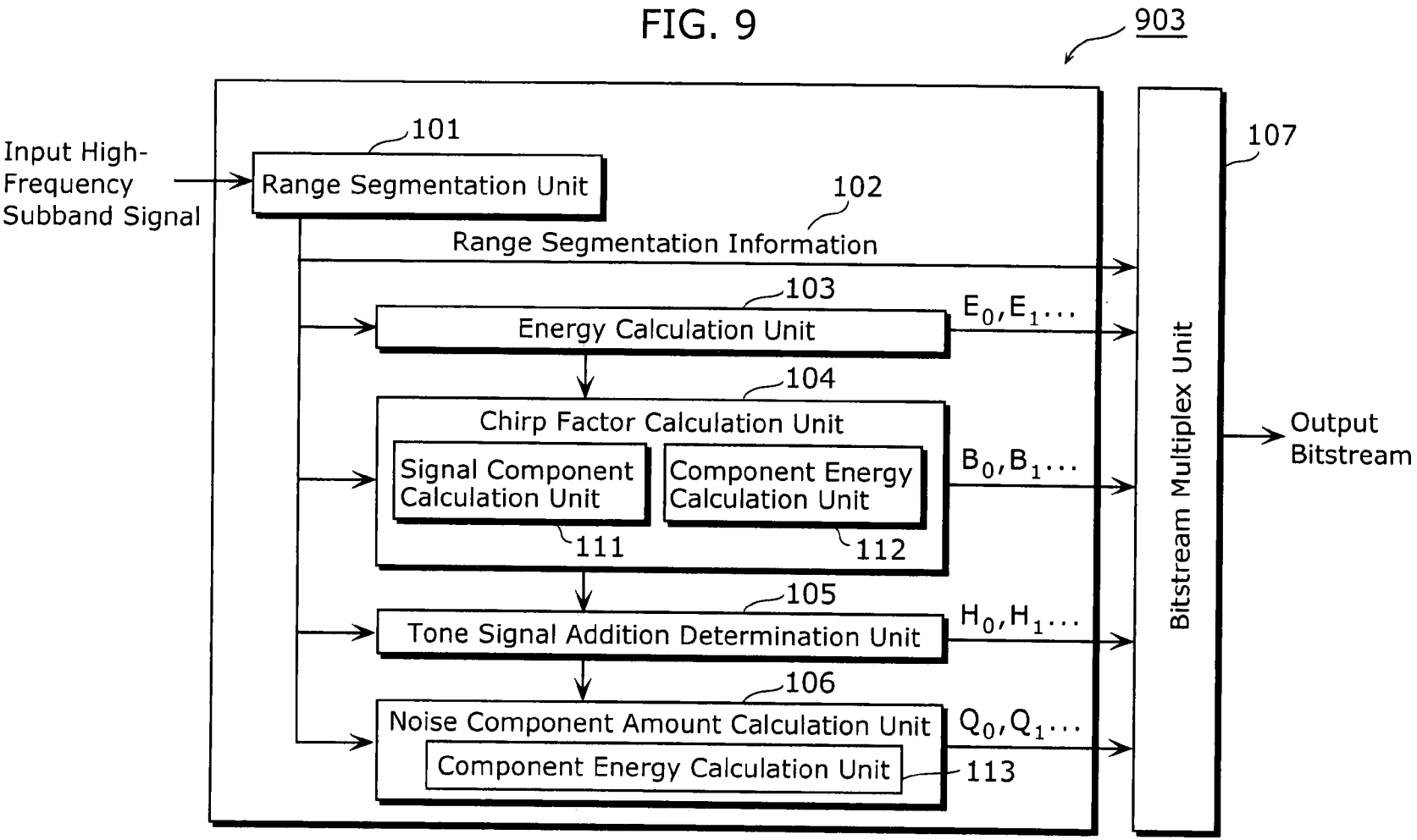
FIG. 9 is a block diagram showing a structure of a bandwidth extension information encoding unit shown in FIG. 8.

FIG. 9 is a block diagram showing a structure of the bandwidth extension information encoding unit 903 shown in FIG. 8. The bandwidth extension information encoding unit 903 according to the present embodiment is a processing unit which generates the bandwidth extension information for generating a high-frequency subband signal by replicating a low-frequency subband signal, without using calculation that requires a large amount of processing loads, such as Fourier transformation. The bandwidth extension information encoding unit 903 includes a range segmentation unit 101, an energy calculation unit 103, a chirp factor calculation unit 104, a tone signal addition determination unit 105, and a noise component amount calculation unit 106. The chirp factor calculation unit 104 includes a signal component calculation unit 111 and a component energy calculation unit 112. Moreover, the noise component calculation unit 106 includes a component energy calculation unit 113. A high-frequency range of a subband signal that has been inputted into the bandwidth extension information encoding unit 903 is divided into a plurality of areas at the range segmentation unit 101. The range segmentation is performed firstly as shown in FIG. 5 by dividing a space indicating a subband signal in the time direction and in the frequency direction and then by grouping the divided areas for energy value calculation, chirp factor calculation, noise component calculation, and tone component calculation, respectively. Thereby, the range segmentation information ei, bi, qi, and hi which are determined for the energy value calculation, the chirp factor calculation, the noise component calculation, and the tone component calculation, respectively, are outputted to the bitstream multiplex unit 904. Note that the range segmentation method may be a predetermined fixed segmentation method, or a flexible method for adaptively segmenting the range by analyzing the input subband so that similar signals exit in the same area. The determined range segmentation information is encoded and transmitted so that a decoder can perform the same range segmentation for the subband indicated by time/frequency representation. Respective subsequent processing for the energy calculation, the chirp factor calculation, the tone component calculation, and the noise component calculation are performed sequentially for the respective corresponding areas.

As described above, a sum of three energy values of the high-frequency subband signal generated by replicating the low-frequency subband signal, the artificially added noise component, and the artificially added tone component is always equal to E(t,k). Therefore, an energy value Ei of the energy band ei can be calculated at the energy calculation unit 103 by calculating average energy of the input high-frequency subband signals in each energy band ei.

Figure 14:
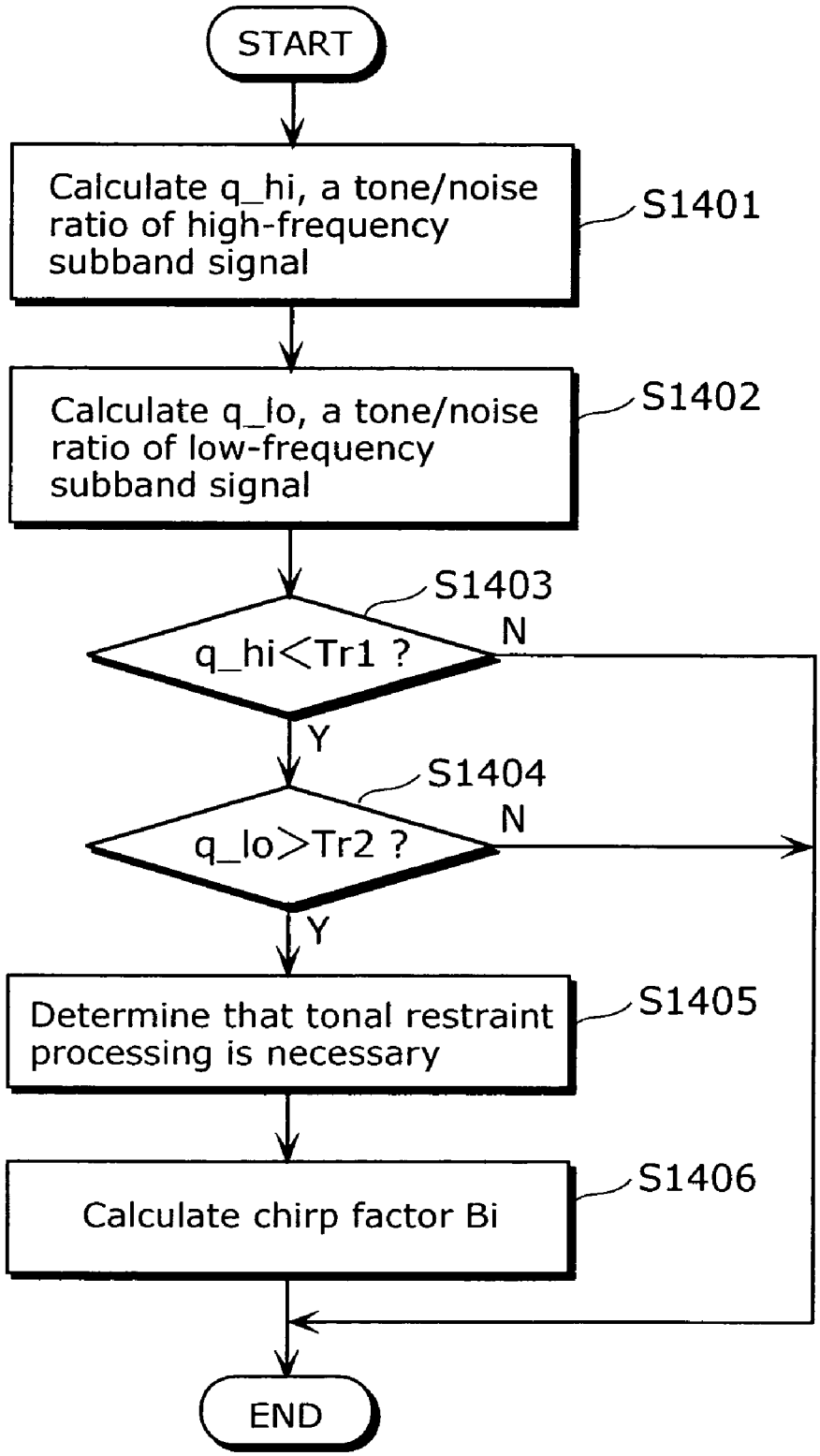
FIG. 14 is a flowchart showing an operation of a chirp factor calculation unit shown in FIG. 9.

Subsequently, an operation of the chirp factor calculation unit 104 is described. FIG. 14 is a flowchart showing the operation of the chirp factor calculation unit 104. A degree of the inverse filtering performed for the low-frequency subband signal is determined depending on how much tonal characteristics of the low-frequency signal to be replicated should be restrained so that a tone-to-noise ratio q_lo(i) of the replicated signal becomes close to a tone-to-noise ratio q_hi(i) of a high-frequency signal of the input signal. A degree of the tonal restraint for the low-frequency signal is controlled using a chirp factor calculated at the chirp factor calculation unit 104. Fundamentals of the method disclosed in the present invention is that the tonal characteristics of the low-frequency subband signal is restrained when the tone-to-noise ratio q_lo (i) of the low-frequency subband signal to be replicated is high though the tone-to-noise ratio q_hi(i) of the input high-frequency subband signal is low. The higher the tone-to-noise ratio of the low-frequency subband signal becomes compared to the tone-to-noise ratio of the high-frequency subband signal, the more tonal restraint is required.

Figure 10:
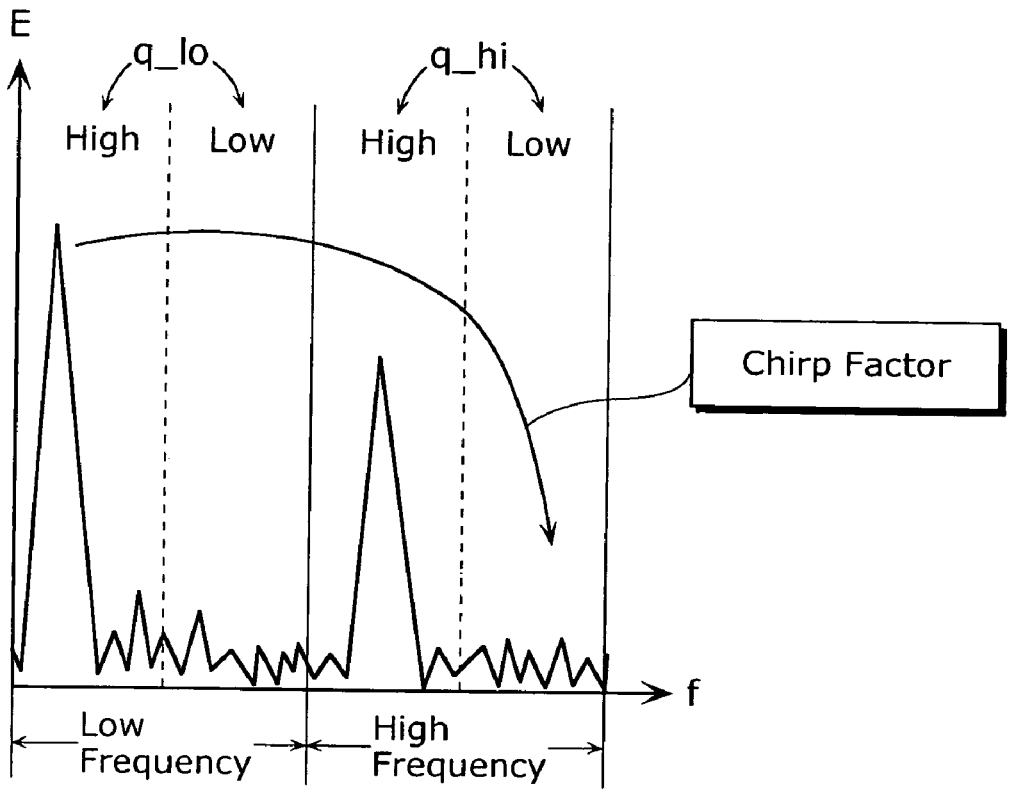
FIG. 10 is a graph showing whether or not tonal restraint of a low-frequency subband signal is necessary, based on a tone-to-noise ratio of an input high-frequency subband signal and a tone-to-noise ratio of a low-frequency subband signal.

FIG. 10 is a graph showing whether or not the tonal restraint of the low-frequency subband signal is necessary, according to the tone-to-noise ratio of the input high-frequency subband signal and the tone-to-noise ratio of the low-frequency subband signal. When the tone-to-noise ratio q_lo(i) of the low-frequency subband signal or the tone-to-noise ratio q_hi(i) of the high-frequency subband signal is high, that means tonal characteristics of such subband is high. On the contrary, when the tone-to-noise ratio q_lo(i) or q_hi (i) is low, that means tonal characteristics of such subband is low (in other words, noise characteristics is high). Therefore, it is understood that as shown in FIG. 10 when the low-frequency subband signal having high tonal characteristics (high q_lo) is replicated at a high-frequency subband where high-frequency subband signal of original signal has low tonal characteristics (low q_hi), the tonal characteristics of the low-frequency subband signal needs to be restrained.

The tone-to-noise ratio of the input high-frequency subband signal can be calculated using linear prediction processing. Assuming that the high-frequency subband signal is indicated as S(t,k), the signal can be divided into a tone component St(t,k) and a noise component Sn(t,k) using the linear prediction processing. The signal component calculation unit 111 applies all high-frequency subbands k included in a chirp factor band bi with the linear prediction processing in order to divide the high-frequency subband signal S(t,k) into the tone component St(t,k) and the noise component Sn(t, k).

$$S(t,k) \approx St(t,k) + Sn(t,k) \quad \text{[Equation 2]}$$

Figures 6A, 6B, 6C:
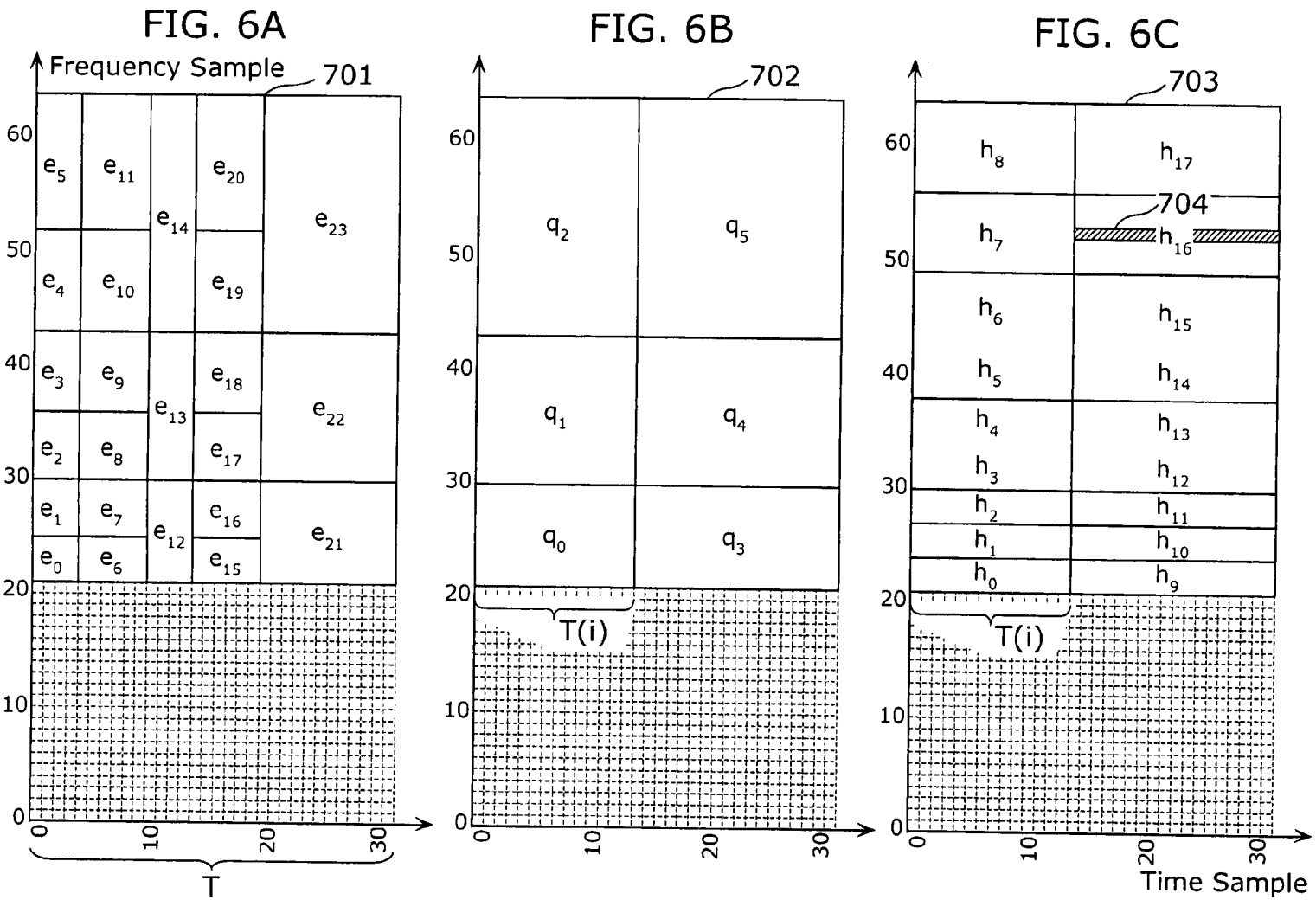
FIG. 6 (*a*) to (*c*) are graphs showing one example of segmentation of the high-frequency subband signal which is obtained by grouping the divided high-frequency area as shown in FIG. 5 as a energy group, a noise group, and a tone group, respectively.

Here, at a certain chirp factor band bi (the same band as the noise band qi at a high-frequency range as shown in FIG. 6(*b*)), a total energy of tone components is calculated by adding the tone components St2(t,k) together during a time period from a time t=0 to T(i), regarding all subbands k (k is a subband number) included in this chirp factor band. Here, T(i) represents a number assigned to a sample in the time direction of the current chirp factor band bi. In the same manner, a total energy of noise components is calculated by adding the noise components Sn2(t,k) together during a time period from a time t=0 to T(i), regarding all subbands k included in the chirp factor band. Using the total energy of tone components and the total energy of noise components, the chirp factor calculation unit 104 calculates a tone-to-noise ratio q_hi(i) of the input high-frequency subband signal in the chirp factor band bi according to the following equation (S1401):

$$q_hi(i) = \frac{\sum_{t \subset T(i)} \sum_{k \subset bi} St^2(t,k)}{\sum_{t \subset T(i)} \sum_{k \subset bi} Sn^2(t,k)}. \quad \text{[Equation 3]}$$

Furthermore, the total energy of tone components St2(t,k) and the total energy of noise components Sn2(t,k) can be calculated using the linear prediction processing according to the following equation:

$$\sum_{t \subset T(i)} St^2(t,k) = |\alpha_0|^2 \phi(1,1) + |\alpha_1|^2 \phi(2,2) + 2Re\{\alpha_0 \alpha_1 * \phi(1,2)\} \quad \text{[Equation 4]}$$

$$\sum_{t \subset T(i)} Sn^2(t,k) = \sum_{t \subset T(i)} S^2(t,k) - \sum_{t \subset T(i)} St^2(t,k), \text{ where}$$

$$\phi(m,n) = \sum_{t \subset T(i)} S(t-m,k) S*(t-n,k) \quad \text{[Equation 5]}$$

$$\alpha_1 = -\frac{\phi(0,1)\phi(1,2) + \phi(0,2)\phi(1,1)}{\phi(2,2)\phi(1,1) - |\phi(1,2)|^2}$$

$$\alpha_0 = -\frac{\phi(0,1) + \alpha_1 \phi*(1,2)}{\phi(1,1)}.$$

As described above, the component energy calculation unit 112 calculates the total energy of tone components St2(t,k) and the total energy of noise components Sn2(t,k) regarding the high-frequency subband signal in the chirp factor band bi.

Assuming that a subband signal in the high-frequency subband k is generated from a low-frequency subband signal indicated by a mapping function p(k) in the replication processing at the decoder, the chirp factor calculation unit 104 calculates the tone-to-noise ratio q_lo(i) of the low-frequency subband signal to be replicated using the following equation (S1402):

$$q_lo(i) = \frac{\sum_{t \subset T(i)} \sum_{k \subset bi} St^2(t, p(k))}{\sum_{t \subset T(i)} \sum_{k \subset bi} Sn^2(t, p(k))}. \quad \text{[Equation 6]}$$

Note that it is obvious that the total energy of tone components St2(t,p(k)) of the low-frequency subband signal to be replicated at the high-frequency subband k, and the total energy of noise components Sn2(t,p(k)) of the low-frequency subband signal can be calculated using the linear prediction processing in the same manner as described for the total energy of tone components St2(t,k) of the input high-frequency subband signal at the high-frequency subband k and the total energy of noise components Sn2(t,k) of the input high-frequency subband signal.

By estimating a magnitude relationship between the tone-to-noise ratio of the input high-frequency subband signal and the tone-to-noise ratio of the low-frequency subband signal to be replicated to the high-frequency subband each of which has been calculated as above, it is possible to determine a degree of necessary tonal restraint. As one example of the method of estimating the magnitude relationship, if the tone-to-noise ratio q_hi(i) of the input high-frequency subband signal is less than the first threshold value Tr1 (Yes at S1403) and the tone-to-noise ratio q_lo(i) of the low-frequency subband signal to be replicated is greater than the second threshold value Tr2 (Yes at S1404), the chirp factor calculation unit 104 determines that the tonal restraint processing is necessary (S1405). Furthermore, the degree of tonal restraint, namely the chirp factor $B_i$, is calculated using the following equation (S1406).

$$B_i = \begin{cases} 0, \text{ if } q_lo(i) < Tr2 \text{ OR } q_hi(i) > Tr1 \\ \left(\frac{q_lo(i) - Tr2}{Tr3 - Tr2}\right)\left(1 - \frac{q_hi(i)}{Tr1}\right) \text{ otherwise} \end{cases} \quad \text{[Equation 7]}$$

$$B_i = \min(B_i, 1).$$

Figure 11:
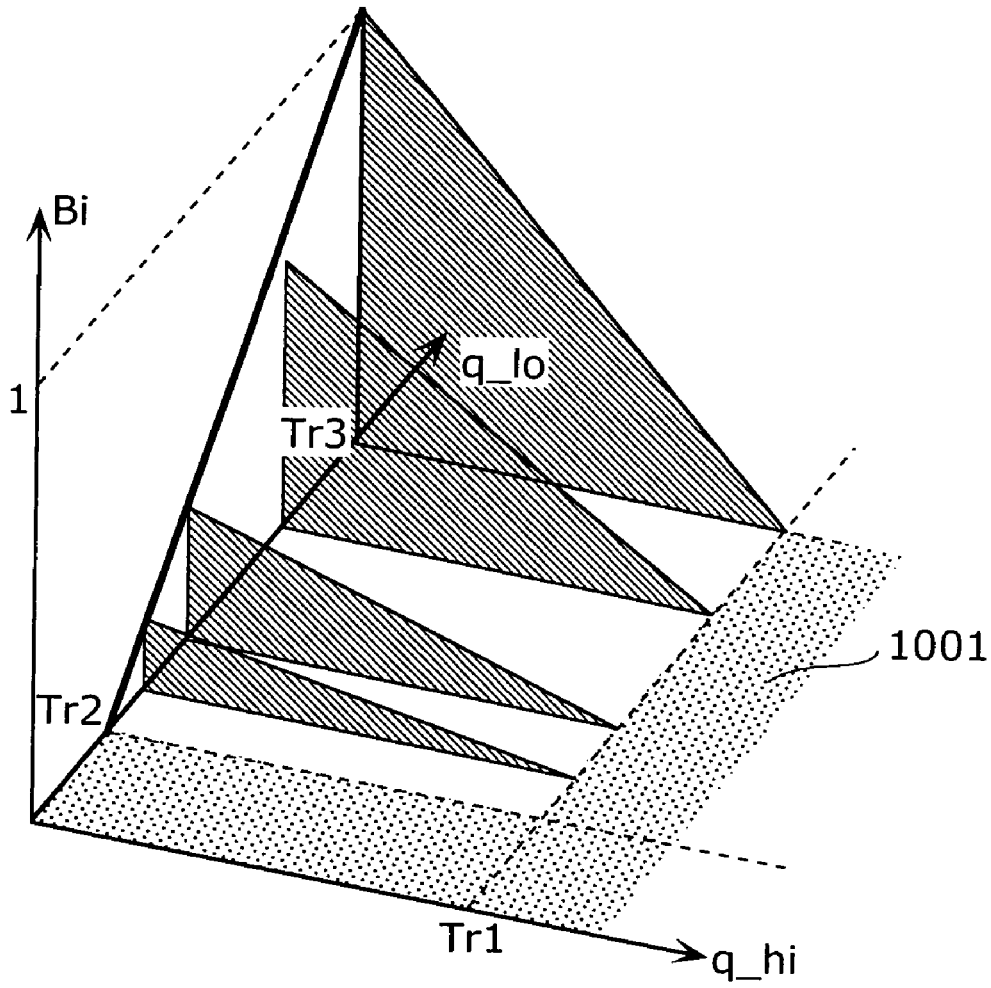
FIG. 11 illustrates a relationship between a calculated chirp factor $B_i$, and the tone-to-noise ratio of the low-frequency subband signal and the tone-to-noise ratio of the input high-frequency subband signal.

Note that Tr3 included in the equation 7 is the third threshold value to determine a saturation point ($B_i$=1) of the chirp factor. This means that when the tone-to-noise ratio q_lo(i) of the low-frequency subband signal becomes greater than the threshold value Tr3, the chirp factor $B_i$ becomes a fixed value of $B_i$=1. The second equation in the equation 7, $B_i$=min ($B_i$,1), means that a smaller value is selected from $B_i$ obtained by the first equation in the equation 7 and "1". FIG. 11 illustrates a relationship between the calculated chirp factor $B_i$ and two tone-to-noise ratios of the low-range sub-band signal and of the input high-range sub-band signal. The chirp factor $B_i$ becomes greater as the q_lo(i) increases, and becomes smaller as the q_hi(i) increases. This means that the chirp factor $B_i$ becomes greater as the tonal characteristics of the low-frequency subband signal is increased, and on the other hand becomes smaller as the tonal characteristics of the high-frequency subband signal is increased. Moreover, in a hatched part indicated as an area 1001, the tone-to-noise ratio q_hi of the input high-frequency subband signal is equal to or more than the threshold value Tr1 (No at S1403 in FIG. 14), or the tone-to-noise ratio q_lo of the low-frequency subband signal is equal to or less than the threshold value Tr2 (No at S1404 in FIG. 14), there the chirp factor calculation unit 104 determines that the tonal restraint processing is not necessary, so that the chirp factor becomes "0". The calculated chirp factor $B_i$ is mapped at the high-frequency subband included in the current chirp factor band and indicated as B(t,k). The chirp factor calculation is repeated until chirp factors are calculated for all chirp factor bands. Each calculated chirp factor is encoded and the encoded data is transmitted to the bitstream multiplex unit 107.

Note that the equation 7 described in the above embodiment is an empirical equation and the most suitable example for calculating the chirp factor. Therefore, the equation for calculating the chirp factor is not limited to the above.

Figure 15:
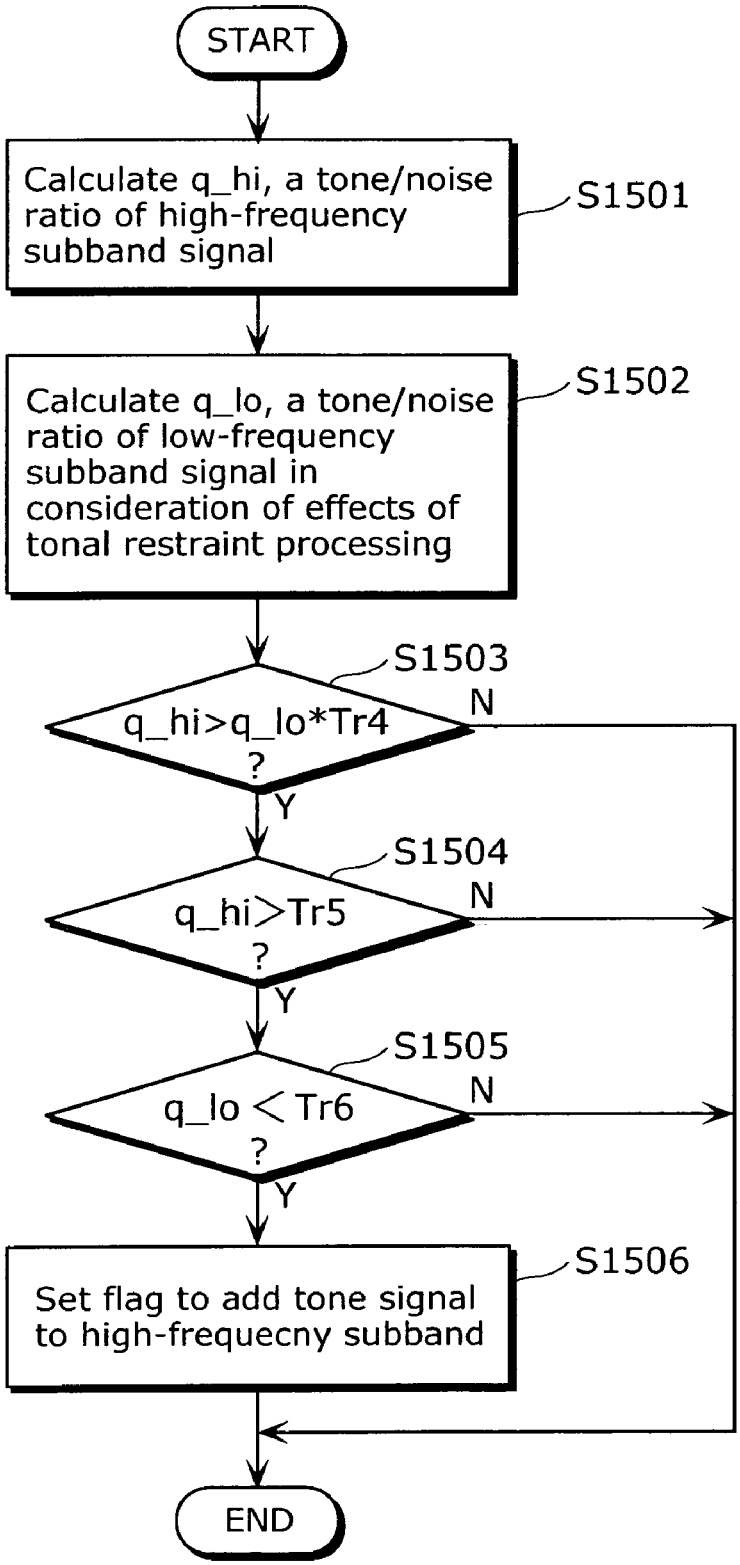
FIG. 15 is a flowchart showing an operation of a tone signal addition determination unit shown in FIG. 9.

Subsequently, an operation of the tone signal addition determination unit 105 is described. FIG. 15 is a flowchart showing the operation of the tone signal addition determination unit 105 shown in FIG. 9. It is possible to determine whether or not each tone band hi described above needs to be added with an artificial tone signal, depending on whether or not the tone-to-noise ratio q_hi of the high-frequency subband signal corresponding to the current tone band is greater than the tone-to-noise ratio q_lo of the low-frequency subband signal to be replicated. However, in order to add the tone signal, further two conditions should be satisfied. One of the conditions is that the tone-to-noise ratio of the high-frequency subband signal has to be an absolutely large value. In other words, even if the tone-to-noise ratio of the high-frequency subband signal is relatively quite larger than the tone-to-noise ratio of the low-frequency subband signal, the tone signal addition is meaningless when the high-frequency subband signal itself has high tonal characteristics. Furthermore, in a case where the high-frequency subband signal is not a signal having pure tonal characteristics, the artificial tone signal addition causes generation of unnatural sound and reduction in the audio quality. The other conditions is that the tone-to-noise ratio of the low-frequency subband signal to be replicated is not extremely high absolutely (not relatively compared to the high-frequency subband signal). When the tone-to-noise ratio of the low-frequency subband signal is quite high, in other words, when the tone-to-noise ratio of the low-frequency subband signal has quite high tonal characteristics, the tone characteristics of the high-frequency subband signal is maintained by tone signal components included in a replicated low-frequency signal, so that it is considered that the artificial tone signal addition is not necessary. Moreover, the tone-to-noise ratio of the low-frequency subband signal to be replicated is influenced by the tonal restraint processing described above, so that the influence needs to be considered.

The tone signal addition determination unit 105 calculates for each tone band hi a tone-to-noise ratio of the high-frequency subband signal and a tone-to-noise ratio of the low-frequency subband signal to be replicated (S1501). Here, the tone-to-noise ratio of the high-frequency subband signal can be calculated using the tone component St(t,k) and the noise component Sn(t,k) that have been calculated at the chirp factor calculation unit 104.

$$q_hi(i) = \frac{\sum_{t \subset T(i)} \sum_{k \subset hi} St^2(t, k)}{\sum_{t \subset T(i)} \sum_{k \subset hi} Sn^2(t, k)}. \quad \text{[Equation 8]}$$

However, the tone-to-noise ratio of the low-frequency subband signal to be replicated requires the consideration of influence of the tonal constraint processing, so that the tone-to-noise ratio of the low-frequency subband signal needs to be processed by processing different from the above-described processing for the tone-to-noise ratio of the high-frequency subband signal. It is possible to obtain an value almost similar to energy reduction of the tone component due to the tonal restraint processing by multiplying the energy reduction with (1-B(t,k)), so that the tone-to-noise ratio of the low-frequency subband signal can be calculated using the following equation (S1502):

$$q_lo(i) = \frac{\sum_{t \subset T(i)} \sum_{k \subset hi} St^2(t, p(k))(1 - B(t, k))}{\sum_{t \subset T(i)} \sum_{k \subset hi} Sn^2(t, p(k))}. \quad \text{[Equation 9]}$$

When the calculated q_lo(i) and q_hi(i) satisfy the following conditions, the tone signal addition determination unit 105 determines that the current tone band needs to be added with an artificial tone signal (S1503 to S1505). That is, $$q_hi(i) > q_lo(i) * Tr4$$

$$\text{and, } q_hi(i) > Tr5, \text{ and, } q_lo(i) < Tr6, \quad \text{[Equation 10]}$$

where Tr4, Tr5, and Tr6 are predetermined threshold values.

The tone signal addition determination unit 105 performs the above tone signal addition determination for all tone bands hi, and information regarding necessity of tone signal addition at each tone band is transmitted to the bitstream multiplex unit 107. Note that the above has described that only "information regarding necessity of tone signal addition" is transmitted to the bitstream multiplex unit 107, but "information indicating a frequency position at a tone band to be added with a tone signal" may be also transmitted together.

Note also that the tone signal addition determination unit 105 may have another structure. With such a structure, despite a shape of the low-frequency subband signal, the artificial tone signal is added only when the input high-frequency subband signal has tone components apparently. Detection of the apparent tone components is performed by determining whether or not any subband signal having extremely high energy is found among a plurality of subband signals having relatively low energy.

Figure 12:
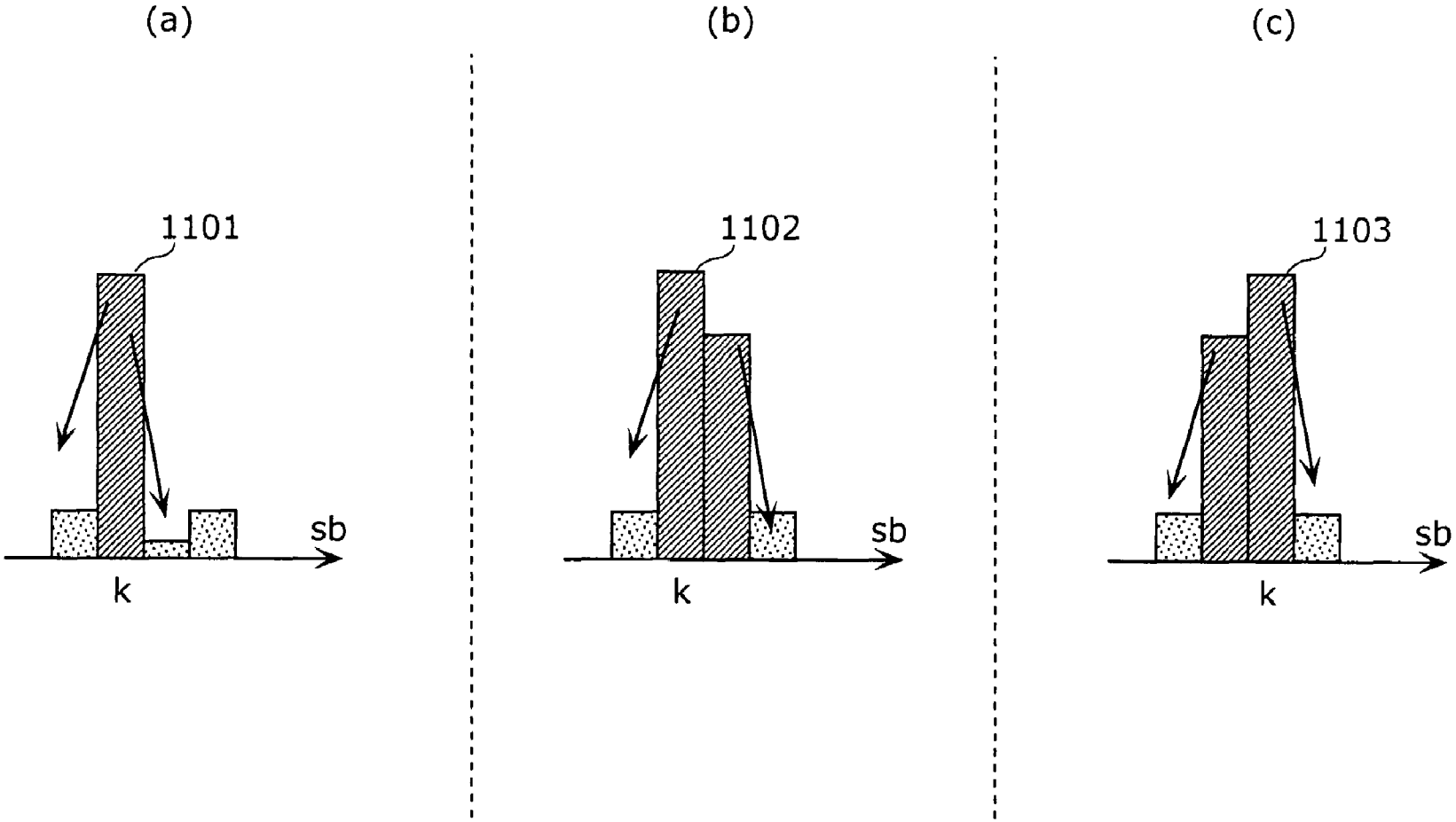
FIG. 12 (*a*) to (*c*) are graphs showing examples of determining a position of a tone component at a tone band by comparing energy of adjacent signals.

FIG. 12(*a*) to (*c*) are graphs showing examples of determining a position of a tone component at a tone band by comparing energy of adjacent signals. In other words, FIG. 12(*a*) to (*c*) show three patterns which are used as references of the tone component determination. The three patterns include (1) the tone component exists nearly at an intermediate position of the frequency at the subband, (2) the tone component exists nearly at an upper limit of the frequency at the subband, and (3) the tone component exists nearly at a lower limit of the frequency at the subband. Here, as an example, each pattern shows that a certain subband k has a tone component. FIG. 12(*a*) shows that a tone component of energy 1101 of the sub-band exists nearly at an intermediate position of the frequency of the subband k. In this case, only the energy of the subband k is relatively large compared to the adjacent subbands. On the other hand, FIG. 12(*b*) shows that a tone component of energy 1102 of the sub-band exists nearly at an upper limit position of the frequency of the subband k. In this case, due to characteristics of a general sub-band filter, a part of the signal energy is leak out to the adjacent subbands, so that energy of a sub-band (k+1) is also increased. In the same manner, FIG. 12(*c*) shows that a tone component of energy 1103 of the sub-band exists nearly at a lower limit position of the frequency of the subband k. In this case, energy of a subband (k−1) is increased. Moreover, at a subband having an apparent tone component or neighborhood subbands, a tone-to-noise ratio of signal is increased. FIG. 13 is a table used for determining whether or not a tone component exists at the current subband by comparing energy of adjacent signals. Based on the above described phenomenon, existence of the apparent tone component at the subband k can be determined using relational expressions shown in the table of FIG. 13. In the table, Ethres and Qthres represent predetermined threshold values of energy and tone-to-noise ratio, respectively, and E(k) represents an energy value calculated using the following equation:

$$E(k) = \sum^{t \subset T(i)} S^2(t, k). \qquad \text{[Equation 11]}$$

The tone signal addition determination unit 105 performs the above determination for all high-frequency subbands k included in the tone band hi based on the three conditions as shown in FIG. 13, and if at least one conditions is satisfied in at least one high-frequency subband, then a determination is made that the current-tone band has an apparent tone signal, and set a flag for artificial tone signal addition (S1506 of FIG. 15). The above determination is made for all tone bands hi, and the flag information indicating whether or not the determined artificial tone signal is to be added is transmitted to the bitstream multiplex unit 107. Note that, in the above example, all of the determination threshold values for the current subband k and the adjacent subbands have been described as an identical value, but each subband may be applied with a different threshold value. Note also that, regarding logical operations of "AND" and "OR" by which the determination results of the respective subbands are summed, a suitable operation can be selected according to an interrelationship between set threshold values. Note also that, regarding the estimation of the tonal characteristics, in consideration of the case where a tone component covers a relatively wide range, the tone-to-noise ratio estimation may be performed also for a few subbands positioned prior or subsequent to the current subband k.

Next, an operation of the noise component calculation unit 106 is described. When a total of the noise components included in the signal to be replicated is almost equal to a total of noise components of the input signal, quality of sound generated from the noise components of the replicated signal becomes similar to quality of sound generated from the noise components of the input signal. Moreover, a noise component is a signal generally covering a wide frequency range, so that the noise component calculation may need consideration of a band covering wider range (called noise band) compared to the above described tone band. Therefore, there is a noise band that includes a plurality of tone bands, so that in order to properly calculate the noise component, the calculation needs to consider difference between a noise component at a tone band added with a tone signal and a noise component at a tone band without tone signal addition. For the low-frequency subband signal to be replicated, the noise component amount is determined so that a noise component total value of the above two components becomes equal to a noise component total value at the current high-frequency subband of the input signal. Note that, the above processing also needs to consider influence of the above described tonal restraint processing.

Firstly, a total of noise components of the input high-frequency subband signal is calculated using the following equation:

$$\sum^{t \subset T(i)} \sum^{k \subset qi} Sn^2(t, k). \qquad \text{[Equation 12]}$$

Here, when a noise component amount in a noise band qi is Qi, for the subband signal to be replicated, a noise component amount obtained from the tone band signal added with a tone signal is determined using the following equation:

$$\sum^{t \subset T(i)} \sum^{k \subset TB(i)} E(t, k)\left(\frac{Q_i}{1 + Q_i}\right) r(t, k), \qquad \text{[Equation 13]}$$

where TB(i) represent a collection of the tone bands added with tones included in the noise band qi. r(t,k) represents a ratio of a noise component included in a high-frequency subband signal to be generated by replication, and in consideration of influence of the tonal restraint processing applied to St(t,p(k)), r(t,k) is determined using the following equation:

$$r(t, k) = \frac{Sn^2(t, p(k))}{Sn^2(t, p(k)) + St^2(t, p(k))(1 - B(t, k))}. \qquad \text{[Equation 14]}$$

Furthermore, for the high-frequency subband signal to be generated by replication, a noise component amount obtained by a tone band without tone signal addition is determined using the following equation:

$$\sum^{t\subset T(i)}\sum^{k\subset NTB(i)}\left(E(t,k)\left(\frac{1}{1+Q_i}\right)r(t,k)+E(t,k)\left(\frac{Q_i}{1+Q_i}\right)\right)=\sum^{t\subset T(i)}\sum^{k\subset NTB(i)}E(t,k)\left(\frac{r(t,k)+Q_i}{1+Q_i}\right),$$ [Equation 15]

where NTB(i) represents a collection of the tone bands without tone signal addition included in the noise band qi. The collection $$TB(i)\cup NTB(i)$$ [Equation 16]

is all tone bands included in the noise band qi. In order to set a sum of all noise components included in the subband signal to be replicated at the noise band qi equal to a noise component of the current input high-frequency subband signal, it is necessary to satisfy the following equation:

$$\sum^{t\subset T(i)}\sum^{k\subset qi}Sn^2(t,k)=\sum^{t\subset T(i)}\sum^{k\subset TB(i)}E(t,k)\left(\frac{Q_i r(t,k)}{1+Q_i}\right)+\sum^{t\subset T(i)}\sum^{k\subset NTB(i)}E(t,k)\left(\frac{r(t,k)+Q_i}{1+Q_i}\right)$$ [Equation 17]

This equation is a simple linear equation so that a noise component amount $Q_i$ is calculated using the following equation:

$$Q_i=\frac{\sum^{t\subset T(i)}\sum^{k\subset qi}Sn^2(t,k)-\sum^{t\subset T(i)}\sum^{k\subset NTB(i)}E(t,k)r(t,k)}{\sum^{t\subset T(i)}\sum^{k\subset TB(i)}E(t,k)r(t,k)+\sum^{t\subset T(i)}\sum^{k\subset NTB(i)}E(t,k)-\sum^{t\subset T(i)}\sum^{k\subset qi}Sn^2(t,k)}$$ [Equation 18]

The noise component amount calculation processing is performed for all noise bands, and the calculated noise amounts $Q_i$ are encoded and transmitted to the bitstream multiplex unit 107. Thus, in the same manner as described for the component energy calculation unit 112 in the chirp factor calculation unit 104, the component energy calculation unit 113 calculates the total energy of the tone component St2(t,k) and the total energy of the noise component Sn2(t,k) regarding the high-frequency subband signal at the noise band qi. However, in addition to the processing performed by the component energy calculation unit 112 of the chirp factor calculation unit 104, the component energy calculation unit 113 in the noise component calculation unit 106 performs noise component correction, in consideration of increase or reduction in the tone components resulted from the chirp factor and the tone signal addition at the same noise band, so that it is possible to calculate a noise component with higher fidelity to the input signal.

Note also that, in the calculation of the noise component $Q_i$, it is possible to reduce the operation amount necessary for the calculation by ignoring the noise component obtained from the tone band added with a tone signal. This is because, in the tone band to be added with a tone signal, a ratio of the tone component in the signal becomes quite high, so that even if a relatively smaller noise component is "0", the influence on the calculated result is small. In this case, an equation for calculating the $Q_i$ is determined using the following equation:

$$Q_i=\frac{\sum^{t\subset T(i)}\sum^{k\subset qi}Sn^2(t,k)-\sum^{t\subset T(i)}\sum^{k\subset NTB(i)}E(t,k)r(t,k)}{\sum^{t\subset T(i)}\sum^{k\subset NTB(i)}E(t,k)-\sum^{t\subset T(i)}\sum^{k\subset qi}Sn^2(t,k)}.$$ [Equation 19]

Note that the above is one example to describe the structure of the present invention, but the particular structure does not limit the scope of the protection of the present invention.

INDUSTRIAL APPLICABILITY

The present invention is a suitable means for improving quality of reproduced audio signal in an equipment which divides an audio signal spectrum into tone components and noise components, and efficiently encodes and decodes the components. That is, the present invention is suitable for an encoder which calculates information to be used at a decoder in order to extend a bandwidth of an audio signal more accurately using a method having less calculation loads, and encodes the calculated information together with a low-frequency signal.

The invention claimed is:

1. A coding equipment which generates a coded signal that includes information for generating a signal at a high-frequency range by replicating a signal at a low-frequency range, the ranges being segments in a time direction and in a frequency direction, said coding equipment comprising:

a high-frequency tone-to-noise ratio calculation unit operable to (i) calculate, by linear prediction processing, the tone components and the noise components which are included in the signal at the segmented high-frequency range, and (ii) calculate, using the calculated tone components and the noise components, a high-frequency tone-to-noise ratio that is a ratio of an energy sum of the tone components to an energy sum of the noise components at the high-frequency range, the tone having signal components that exist intensely at a specific frequency range and the noise having signal components that exist regardless of frequency range;

a low-frequency tone-to-noise ratio calculation unit operable to (i) calculate, by linear prediction processing, the tone components and the noise components which are included in the signal at the low-frequency range corresponding to the high-frequency range, the low-frequency range being to be replicated at the high-frequency, and (ii) calculate, using the calculated tone components and the noise components, a low-frequency tone-to-noise ratio that is a ratio of an energy sum of the tone components to an energy sum of the noise components in the signal at the low-frequency range corresponding to the high-frequency range;

an adjustment coefficient calculation unit operable to calculate an adjustment coefficient which is used to adjust tonal characteristics of the signal at the low-frequency range to be replicated at the high-frequency range, based on the high-frequency tone-to-noise ratio and the low-frequency tone-to-noise ratio; and an encoding unit operable to generate the coded signal that includes the calculated adjustment coefficient.

2. The coding equipment according to claim 1, wherein said adjustment coefficient calculation unit includes a tonal restraint determination unit operable to determine that restraint on the tonal characteristics of the signal at the low-frequency range is necessary, when the high-frequency tone-to-noise ratio $q_{13}$ hi(i) is smaller than a first threshold value In and the low-frequency tone-to-noise ratio $q_{13}$ lo(i) regarding the low-frequency corresponding to the high-frequency range is greater than a second threshold value Tr2, and said adjustment coefficient calculation unit is operable to calculate the adjustment coefficient according to equation 7, when as a result of the determination the restraint on the tonal characteristics is necessary, $$B_i = \begin{cases} 0, & \text{if } q_lo(i) < Tr2 \text{ OR } q_hi(i) > Tr1, \\ \left(\frac{q_lo(i) - Tr2}{Tr3 - Tr2}\right)\left(1 - \frac{q_hi(i)}{Tr1}\right) & \text{otherwise} \end{cases} \quad \text{[Equation 7]}$$

$$B_i = \min(B_i, 1).$$

3. A coding equipment which generates a coded signal that includes information for generating a signal at a high-frequency range by replicating a signal at a low-frequency range, the ranges being segments in a time direction and in a frequency direction, said coding equipment comprising:

a tone-to-noise ratio calculation unit operable to calculate, using linear prediction processing, a tone-to-noise ratio of the signal at the segmented high-frequency range and a tone-to-noise ratio of the signal at the low-frequency range to be replicated at the high-frequency range, the tone having signal components that exist intensely at a specific frequency range and the noise having signal components that exist regardless of frequency range;

an adjustment coefficient calculation unit operable to calculate an adjustment coefficient which is used to adjust tonal characteristics of the signal at the low-frequency range to be replicated at the high-frequency range, based on the tone-to-noise ratios calculated regarding the signals at the low frequency range and the high frequency range;

an encoding unit operable to generate the coded signal that includes the calculated adjustment coefficient; and a tone signal addition determination unit operable to determine whether or not a predetermined signal having the tonal characteristics is to be added to the signal at the low-frequency range to be replicated at the high-frequency range, based on the tone-to-noise ratios calculated regarding the signals at the low-frequency range and the high-frequency range, wherein said encoding unit is operable to generate the coded signal which includes a determination result of said tone signal addition determination unit.

4. The coding equipment according to claim 3, wherein said adjustment coefficient calculation unit is operable to calculate an adjustment coefficient which indicates a degree of the restraint on the tonal characteristics of the signal at the low-frequency range to be replicated, and said tone signal addition determination unit is operable to determine whether or not the signal having the tonal characteristics is to be added after amending the tone-to-noise ratio of the signal at the low-frequency range according to reduction in energy of the signal components at the low-frequency range due to the constraints on the tonal characteristics of the signal at the low-frequency range using the calculated adjustment coefficient.

5. The coding equipment according to claim 4, wherein said tone signal addition determination unit is operable to amend the tone-to-noise ratio q_(i) of the signal at the low-frequency range according to the reduction in the energy of the signal components at the low-frequency range due to the restraint on the tonal characteristics of the signal at the low-frequency range using the calculated adjustment coefficient Bi, the correction being performed according to equation 9 when the determination is made as to whether or not the signal having the tonal characteristics is to be added, $$q_lo(i) = \frac{\sum_{t \subset T(i)} \sum_{k \subset hi} St^2(t, p(k))(1 - B(t, k))}{\sum_{t \subset T(i)} \sum_{k \subset hi} Sn^2(t, p(k))} \quad \text{[Equation 9]}$$

where t represents the number of samples from t=0 to t=T(i) in the time direction, and k represents k subbands included in a tone band hi segmented in the frequency direction.

6. The coding equipment according to claim 5, wherein said tone signal addition determination unit is operable to determine that the signal having the tonal characteristics is to be added to the high-frequency range, when the high-frequency tone-to-noise ratio q_hi (i) and the low-frequency tone-to-noise ratio q_lo (i) that is corrected in order to compensate the restraint on the tonal characteristics of the signal at the low-frequency range using the calculated adjustment coefficient Bi satisfy conditions indicated by equation 10, $$q_hi(i) > q_lo(i) * Tr4$$

$$\text{and, } q_hi(i) > Tr5, \text{ and, } q_lo(i) < Tr6, \quad \text{[Equation 10]}$$

where Tr4, Tr5, and Tr6 are predetermined threshold values.

7. The coding equipment according to claim 3, wherein said tone signal addition determination unit is operable to determine whether or not the signal having the tonal characteristics is to be added to the high-frequency range, based on an energy distribution of the signal at the segmented high-frequency range and the tone-to-noise ratio of the signal at the high-frequency range.

8. The coding equipment according to claim 7, wherein said tone signal addition determination unit is operable to determine that the signal having the tonal characteristics is to be added, when a signal having extremely high energy is found among a plurality of signals having relatively low energy at the segmented high-frequency range.

9. A coding equipment which generates a coded signal that includes information for generating a signal at a high-frequency range by replicating a signal at a low-frequency range, the ranges being segments in a time direction and in a frequency direction, said coding equipment comprising:

a tone-to-noise ratio calculation unit operable to calculate, using linear prediction processing, a tone-to-noise ratio of the signal at the segmented high-frequency range and a tone-to-noise ratio of the signal at the low-frequency range to be replicated at the high-frequency range, the tone having signal components that exist intensely at a specific frequency range and the noise having signal components that exist regardless of frequency range;

an adjustment coefficient calculation unit operable to calculate an adjustment coefficient which is used to adjust tonal characteristics of the signal at the low-frequency range to be replicated at the high-frequency range, based on the tone-to-noise ratios calculated regarding the signals at the low frequency range and the high frequency range;

an encoding unit operable to generate the coded signal that includes the calculated adjustment coefficient;

a signal component calculation unit operable to calculate, using linear prediction processing, the tone components and the noise components which are included in the signal at the segmented high-frequency range; and a component energy calculation unit operable to calculate energy of the signal at the high-frequency range and energy of the noise components included in the energy of the signal at the high-frequency range, based on respective energy of the calculated tone components and noise components, wherein said encoding unit is operable to generate a coded signal which includes information indicating the energy of the signal at the high-frequency range and information indicating the energy of the noise components included in the energy.

10. The coding equipment according to claim 9, wherein said adjustment coefficient calculation unit is operable to calculate an adjustment coefficient which indicates a degree of the restraint on the tonal characteristics of the signal at the low-frequency range to be replicated, and said component energy calculation unit is further operable to calculate the energy of the noise components included in the energy of the signal at the high-frequency range, after amending the energy of the tone components at the low-frequency range according to the restraint on the tonal characteristics of the signal at the low-frequency range using the calculated adjustment coefficient.

11. The coding equipment according to claim 10, wherein said component energy calculation unit is operable to calculate the noise components of the energy at the high-frequency range by calculating a sum of noise components resulted from the signal at a subband added with the signal having the tonal characteristics and noise components resulted from the signal at a subband without being added with the signal having the tonal characteristics, regarding all subbands corresponding to the high-frequency range.

12. The coding equipment according to claim 10, wherein said component energy calculation unit is further operable to calculate the energy of the noise components at the high-frequency range, depending on whether or not the signal having the tonal characteristics is to be added to the signal at the low-frequency range to be replicated at the high-frequency range.

13. A coding method of generating a coded signal that includes information for generating a signal at a high-frequency range by replicating a signal at a low-frequency range, the ranges being segments in a time direction and in a frequency direction, said coding method comprising:

calculating, using linear prediction processing, a tone-to-noise ratio of the signal at the segmented high-frequency range and a tone-to-noise ratio of the signal at the low-frequency range to be replicated at the high-frequency range, the tone having signal components that exist intensely at a specific frequency range and the noise having signal components that exist regardless of frequency range;

calculating an adjustment coefficient which is used to adjust tonal characteristics of the signal at the low-frequency range to be replicated at the high-frequency range, based on the tone-to- noise ratios calculated regarding the signals at the low frequency range and the high frequency range;

generating the coded signal that includes the calculated adjustment coefficient;

determining whether or not a predetermined signal having the tonal characteristics is to be added to the signal at the low-frequency range to be replicated at the high-frequency range, based on the tone-to-noise ratios calculated regarding the signals at the low-frequency range and the high-frequency range; and generating the coded signal which includes a result of said determining.

14. A coding method which for generating a coded signal that includes information for generating a signal at a high-frequency range by replicating a signal at a low-frequency range, the ranges being segments in a time direction and in a frequency direction, said coding method comprising:

using a high-frequency tone-to-noise ratio calculation unit (i) calculating, by linear prediction processing, the tone components and the noise components which are included in the signal at the segmented high-frequency range, and (ii) calculating, using the calculated tone components and the noise components, a high-frequency tone-to-noise ratio that is a ratio of an energy sum of the tone components to an energy sum of the noise components at the high-frequency range, the tone having signal components that exist intensely at a specific frequency range and the noise having signal components that exist regardless of frequency range;

using a low-frequency tone-to-noise ratio calculation unit (i) calculating, by linear prediction processing, the tone components and the noise components which are included in the signal at the low-frequency range corresponding to the high-frequency range, the low-frequency range being to be replicated at the high-frequency; and (ii) calculating, using the calculated tone components and the noise components, a low-frequency tone-to-noise ratio that is a ratio of an energy sum of the tone components to an energy sum of the noise components in the signal at the low-frequency range corresponding to the high-frequency range, calculating, using an adjustment coefficient calculation unit, an adjustment coefficient which is used to adjust tonal characteristics of the signal at the low-frequency range to be replicated at the high-frequency range, based on the tone-to-noise ratios calculated regarding the signals at the low frequency range and the high frequency range; and generating, using an encoding unit, the coded signal that includes the calculated adjustment coefficient.

15. A program stored on a computer-readable storage medium for use in coding equipment for generating a coded signal that includes information for generating a signal at a high-frequency range by replicating a signal at a low-frequency range, the ranges being segments in a time direction and in a frequency direction, said program when executed by a processor causes the coding equipment to perform steps comprising:

calculating, by linear prediction processing, the tone components and the noise components which are included in the signal at the segmented high-frequency range;

calculating, using the calculated tone components and the noise components, a high-frequency tone-to-noise ratio that is a ratio of an energy sum of the tone components to an energy sum of the noise components at the high-frequency range, the tone having signal components that exist intensely at a specific frequency range and the noise having signal components that exist regardless of frequency range;

calculating, by linear prediction processing, the tone components and the noise components which are included in the signal at the low-frequency range corresponding to the high-frequency range, the low-frequency range being to be replicated at the high-frequency;

calculating, using the calculated tone components and the noise components, a low-frequency tone-to-noise ratio that is a ratio of an energy sum of the tone components to an energy sum of the noise components in the signal at the low-frequency range corresponding to the high-frequency range;

calculating an adjustment coefficient which is used to adjust tonal characteristics of the signal at the low-frequency range to be replicated at the high-frequency range, based on the tone-to-noise ratios calculated regarding the signals at the low frequency range and the high frequency range; and generating the coded signal that includes the calculated adjustment coefficient.

* * * * *

UNITED STATES PATENT AND TRADEMARK OFFICE

CERTIFICATE OF CORRECTION

PATENT NO. : 7,668,711 B2
APPLICATION NO. : 10/575452
DATED : February 23, 2010
INVENTOR(S) : Kok Seng Chong et al.

It is certified that error appears in the above-identified patent and that said Letters Patent is hereby corrected as shown below:

In column 17, claim 2, line 1, "$q_{13}$ hi(i)" should read --q_ hi(i)--.

In column 17, claim 2, line 2, "first threshold value In" should read --first threshold value Tr1--.

In column 17, claim 2, line 3, "ratio $q_{13}$ lo(i)" should read --ratio q_ lo(i)--.

In column 18, claim 5, line 3, "ratio q_ (i)" should read --ratio q_ lo(i)--.

Signed and Sealed this

Fifteenth Day of June, 2010

David J. Kappos

David J. Kappos
*Director of the United States Patent and Trademark Office*